US008106734B2

(12) United States Patent
Gruden

(10) Patent No.: US 8,106,734 B2
(45) Date of Patent: Jan. 31, 2012

(54) ADJUSTABLE MID AIR GAP MAGNETIC LATCHING SOLENOID

(75) Inventor: James M. Gruden, Centerville, OH (US)

(73) Assignee: Saia-Burgess, Inc., Vandalia, OH (US)

( * ) Notice: Subject to any disclaimer, the term of this patent is extended or adjusted under 35 U.S.C. 154(b) by 84 days.

(21) Appl. No.: 12/109,476

(22) Filed: Apr. 25, 2008

(65) Prior Publication Data

US 2009/0072636 A1 Mar. 19, 2009

Related U.S. Application Data

(60) Provisional application No. 60/907,972, filed on Apr. 25, 2007, provisional application No. 60/996,888, filed on Dec. 10, 2007.

(51) Int. Cl.
*H01F 7/00* (2006.01)
*H01F 7/08* (2006.01)

(52) U.S. Cl. ..... 335/229; 335/220

(58) Field of Classification Search ..... 335/220–229; 251/129.06

See application file for complete search history.

(56) References Cited

U.S. PATENT DOCUMENTS

| | | | | |
|---|---|---|---|---|
| 3,157,831 | A | 11/1964 | Ray | |
| 4,078,709 | A | 3/1978 | Jenkins | |
| 4,733,212 | A * | 3/1988 | Goodwin | 335/253 |
| 4,812,884 | A | 3/1989 | Mohler | |
| 5,138,291 | A | 8/1992 | Day | |
| 5,239,277 | A | 8/1993 | Vielot | |
| 5,453,724 | A | 9/1995 | Seymour et al. | |
| 6,229,421 | B1 | 5/2001 | Floyd et al. | |
| 6,512,435 | B2 | 1/2003 | Van Namen | |
| 6,615,780 | B1 * | 9/2003 | Lin et al. | 123/90.17 |
| 6,791,442 | B1 | 9/2004 | Schmidt | |
| 7,053,742 | B2 | 5/2006 | Lanni et al. | |
| 7,280,019 | B2 | 10/2007 | Kolb et al. | |
| 2006/0061442 | A1 | 3/2006 | Brooks | |

FOREIGN PATENT DOCUMENTS

WO 2004/064084 A2 7/2004

OTHER PUBLICATIONS

International Search Report and Written Opinion mailed Aug. 8, 2008 in PCT application PCT/US2008/065426.

International Search Report and Written Opinion mailed Aug. 8, 2008 in corresponding PCT application PCT/US08/05328.

U.S. Office Action mailed May 12, 2010 in co-pending U.S. Appl. No. 12/130,941.

International Preliminary Report on Patentability mailed Dec. 10, 2009 in PCT Application No. PCT/US2008/065426.

* cited by examiner

*Primary Examiner* — Bernard Rojas
(74) *Attorney, Agent, or Firm* — Nixon & Vanderhye, P.C.

(57) ABSTRACT

A magnetic latching solenoid comprises a housing, a moveable magnetically permeable member, a stationary magnetic assembly, a counter flux generator; and, a spring. A substantially equal extent of the moveable magnetically permeable member and stationary magnetic assembly along results in an air gap interface being essentially mid-way between the opposite axial extremities of the moveable magnetically permeable member and stationary magnetic assembly, thereby enhancing an attracting force of a permanent magnet that comprises the stationary magnetic assembly. In an example embodiment, the stationary magnetic assembly comprises a pole member which is adjustably positionable to minimize air gaps.

28 Claims, 12 Drawing Sheets

ADJUSTABLE MID AIR GAP MAGNETIC LATCHING SOLENOID

This application claims the priority and benefit of U.S. Provisional Patent Application 60/907,972, filed Apr. 25, 2007, entitled "ADJUSTABLE MID AIR GAP MAGNETIC LATCHING SOLENOID"; and U.S. Provisional Patent Application 60/996,888, filed Dec. 10, 2007, entitled "ADJUSTABLE MID AIR GAP MAGNETIC LATCHING SOLENOID"; both of which are incorporated herein by reference in their entirety.

BACKGROUND

I. Technical Field

This invention pertains to the field of solenoids, and particularly to magnetic latching solenoids.

II. Related Art and Other Considerations

A typical solenoid has a moveable member which is connected to or integral with a plunger or piston. The moveable piston or plunger, which can be in the form of an output shaft, is the serving or working element/aspect of the solenoid that can be employed in any of various applications or utilizations.

One type of solenoid is a "power stroking" or "power on" solenoid. In a natural state of a power stroking solenoid, the solenoid moveable member is separated by an air gap from a solenoid stationary member. The solenoid also has a coil or the like which, when energized, creates a magnetic flux. The magnetic flux generated by the coil results in the moveable member being electromagnetically attracted to the stationary member(s). Depending on the positioning and configuration of the piston relative to the moveable member, attraction of the moveable member toward the stationary member can cause the piston to be retracted or extended relative to its original position. The moveable member is held in place (in attraction) to the stationary member until power is removed from the coil. When power is removed, the moveable member returns to its original separated position (e.g., the moveable member is again separated from the stationary member by an air gap). Return of the moveable member to its original position is often facilitated by a spring or the like. An example power stroking solenoid which operates generally in accordance with the foregoing but with piston extension upon power stroking is shown in U.S. Pat. No. 4,812,884 to Mohler, entitled "Three-Dimensional Double Air Gap High Speed Solenoid", which is incorporated herein by reference.

In contrast to a power stroking solenoid, a "holding" solenoid starts with a minimal air gap between the moveable member and the stationary member. When the holding solenoid is powered (e.g. by energization of a solenoid coil), the electromagnetic attractive forces hold the moveable member rigidly to the stationary member.

A magnetic latching or "maglatch solenoid" is a derivative of the "holding solenoid" and further includes an internally compressed spring and a permanent magnet. In its natural (and unpowered) state, the moveable member is magnetically latched to the stationary member while compressing the spring. When powered, the permanent magnet's holding force is reduced sufficiently that the spring can force the moveable member away from the stationary member.

Thus, a magnetic latching solenoid typically comprises a coil, a spring, a permanent magnet, and at least two metal components that provide a magnetic path for the magnet's flux. The spring is located between the two metal components, one of which contains the permanent magnet. As the one metal component moves toward the other, the spring is compressed. When the metal parts are brought within close proximity of each other, they latch together since the magnetic attracting force between the two metal components is greater than the opposing mechanical spring force. To unlatch (release) a magnetically latched solenoid, current (power) is applied to the coil housed within the metal components. This release power provides sufficient magnetic flux to offset/cancel the permanent magnet's flux, such that the spring force is now greater than the magnetic attracting force between the two metal components. With the magnetic attracting force thus overcome, the metal components separate (unlatch). Applications for this type of solenoid include circuit breakers, door locks, brake locks, etc.

As the moving metal component is re-latched to its mating stationary metal component during repeated actuations, variations in the magnetic circuit and air gaps between the metal components of typical magnetic latching solenoids result in release power variations that are unacceptable to the customer. Release power is the power (current and voltage) applied to the coil that allows the moveable member to be released from the stationary member. The release power variations can result in piston action that is non-uniform (e.g., with respect to one or more of piston position/placement, piston actuation power, or piston speed/response).

Since air gaps reduce magnetic efficiency when latched, a "zero" air gap magnetic latching solenoid is optimal. The location and size of air gaps, e.g., gaps between the moveable member and the stationary member, significantly affect the solenoid's performance. Even the smallest air gap is deleterious to the electromagnetic flux fields and flux paths which travel through the stationary member and the moveable member. Although a zero air gap is not yet achievable with contemporary designs, the air gap should be kept as small as possible.

BRIEF SUMMARY

In one of its aspects the technology concerns a magnetic latching solenoid. The solenoid comprises a housing, a moveable magnetically permeable member, a stationary magnetic assembly, a counter flux generator; and, a spring.

The housing comprises a housing first end. The housing at least partially defines a housing cavity. The moveable magnetically permeable member is configured to translate at least partially within the housing from a latched position to a stroked position along an axis. The moveable member comprises a plunger, a housing-confined shoulder surface, and a moveable mating surface. The plunger is extendable through an aperture in the housing first end. The housing-confined shoulder surface is contiguous to the plunger and lies at least partially in a first plane transverse to the axis when in the latched position. The moveable mating surface lies at least partially in a second plane transverse to the axis when in the latched position.

The stationary magnetic assembly is situated at least partially in the housing and in the housing cavity. The stationary magnetic assembly comprises a stationary magnetically permeable member and a permanent magnet. The stationary magnetically permeable member comprises at least one magnetized mating surface. The permanent magnet is configured to generate a permanent magnetic flux field in the stationary magnetically permeable member and in the moveable magnetically permeable member. The flux field generated by the permanent magnet and conducted through a magnetic circuit is sufficient to retain the moveable magnetically permeable member essentially in contact with the stationary magnetically permeable member at an air gap interface between the stationary magnetically permeable member and the moveable magnetically permeable member when in the latched position (absent a counter flux field which overcomes the permanent magnetic flux field).

The moveable magnetically permeable member and members of the stationary magnetic assembly comprise a magnetic circuit for conducting magnetic flux. The members of the stationary magnetic assembly that comprise the magnetic circuit (also known as stationary circuit members) include a stationary case, the stationary magnetically permeable member (also known as a pole member); the permanent magnet, and a plate. The stationary magnetically permeable member is located between the moveable magnetically permeable member and the permanent magnet with respect to the axis. An axial extent of the moveable magnetically permeable member along the axis from the shoulder surface to the moveable mating surface is essentially the same as an axial extent of the stationary magnetic assembly (e.g., the stationary circuit members) along the axis.

The spring is configured to bias the moveable magnetically permeable member away from the stationary magnetically permeable assembly when a counter flux generated by the counter flux generator overcomes the permanent magnetic flux.

In an example embodiment, the housing cavity is essentially open opposite the housing first end, and wherein the solenoid further comprises a plate and a cover. The plate has a major dimension which is transverse to the axis. The cover is configured to enclose the housing cavity. The housing and the cover are configured whereby the moveable magnetically permeable member, the stationary magnetically permeable member, the permanent magnet, and the plate can be axially aligned in this order within a volume defined by the housing and the cover.

In an example embodiment, the stationary magnetically permeable member comprises two magnetized mating surfaces. The stationary magnetically permeable member comprises a stationary case member and a pole member. The case member at least partially defines a case cavity and comprises one magnetized mating surface. The pole member is configured for selective positioning within the case cavity along the axis and thereby provides another magnetized mating surface independently positionable along the axis relative to the magnetized mating surface of the case member. In an example implementation, at least portions of the field generator, the pole member (e.g., stationary magnetically permeable member), and the permanent magnet are transversely interior to the stationary case member.

In an example implementation, the moveable magnetically permeable member comprises an axially extending central portion and an axially extending peripheral portion. The moveable magnetically permeable member comprises two moveable mating surfaces, a first moveable mating surface provided on the axially extending central portion and a second moveable mating surface provided on the axially extending peripheral portion.

In an example implementation, a moveable member cavity is defined between an axially extending central portion and an axially extending peripheral portion of the moveable magnetically permeable member. A stationary cavity is defined between the stationary case member and the pole member. The moveable member cavity and the stationary cavity are axially aligned. The counter flux generator is positioned at least partially in the moveable member cavity and the stationary cavity.

In an example implementation, the spring comprises a conical spring situated in the moveable member cavity. The conical spring has a first end coil lying in a first spring end plane and a second end coil lying in a second spring end plane. The second end coil has a greater diameter than the first end coil. The second end coil contacts a radially extending interior surface of the moveable magnetically permeable member In an example implementation, the flux generator comprises a bobbin frame. The bobbin frame comprises an axially extending bobbin flange and a transverse bobbin flange which extend into the moveable member cavity. The first end coil of the spring is separated from the central core of the moveable magnetically permeable member by the axially extending bobbin flange.

In another aspect, the technology concerns a magnetic latching solenoid comprising an essentially open-mouthed housing, a moveable magnetically permeable member, a stationary magnetic assembly, a counter flux generator; and, a spring.

The housing comprises a housing first end and at least partially defines a housing cavity. The housing cavity has an essentially open housing mouth (which is essentially open opposite the housing first end).

The moveable magnetically permeable member configured to translate at least partially within the housing from a latched position to a stroked position along an axis. The moveable magnetically permeable member comprises a moveable mating surface at least partially lying in a plane transverse to the axis when in the latched position.

The stationary magnetic assembly is situated at least partially in the housing and in the cavity and configured for insertion through the housing mouth. The stationary magnetic assembly comprises a stationary case member, a pole member, a permanent magnet, and a plate. The stationary case member at least partially defines a case cavity and comprises a peripheral magnetized mating surface. The pole member comprises another, e.g., central, magnetized mating surface. The permanent magnet is configured to generate a permanent magnetic flux field in the pole member, in the moveable magnetically permeable member, and in the stationary case member which is sufficient to retain the moveable magnetically permeable member essentially in contact with the stationary magnetically permeable assembly at an air gap interface between the stationary magnetically permeable assembly and the moveable magnetically permeable member when in the latched position (absent a counter flux field which overcomes the permanent magnetic flux field).

The pole member is located between the moveable magnetically permeable member and the permanent magnet with respect to the axis. The pole member comprises a configuration for being selective positioned through the housing mouth and within the case cavity along the axis whereby the central magnetized mating surface on the pole member is positionable along the axis relative to the moveable mating surface in a manner that is independent of the first magnetized mating surface.

The spring is configured to bias the moveable magnetically permeable member away from the stationary magnetically permeable assembly when a counter flux generated by the counter flux generator overcomes the permanent magnetic flux.

In an example implementation, the stationary magnetic assembly is distinct from the housing, and the housing is non-magnetically permeable.

Another aspect of the technology includes a method of making a magnetically latched solenoid. The method begins with providing a housing. The housing comprises a housing first end and at least partially defines a housing cavity through which an axis extends (which is essentially open opposite the housing first end). Moreover, the housing cavity having an essentially open housing mouth.

The method also includes inserting, into the housing cavity, a moveable magnetically permeable member and a spring. The moveable magnetically permeable member comprises an axially extending central portion and an axially extending peripheral portion. A moveable member cavity is defined between the axially extending central portion and the axially extending peripheral portion. The spring is provided for biasing the moveable magnetically permeable member toward the housing first end.

The method further includes inserting, through the housing mouth and into the housing cavity, the following: a pole member, a counter flux generator, a stationary case member; and, a permanent magnet. The pole member comprises a pole member mating surface. The counter flux generator is inserted at least partially into the moveable member cavity. The stationary case member at least partially defines a case cavity and comprises a peripheral magnetized mating surface. Upon insertion of the stationary case member, the case cavity is occupied at least partially by the counter flux generator and the pole member.

The method also includes applying a force which acts on the pole member for driving the pole member mating surface toward the moveable magnetically permeable member and thereby adjusting a central air gap between the pole member mating surface and the moveable magnetically permeable member, the central air gap being adjusted independently of a peripheral air gap between the peripheral mating surface of the stationary case member and the moveable magnetically permeable member.

In one example embodiment and mode, the method comprises inserting certain elements through the housing mouth in a predefined order. These elements are stationary circuit elements which happened to be axially aligned, e.g., the pole member, the permanent magnet, and the plate. The force is applied to a selected one of these (e.g., axially aligned) elements upon insertion of the selected one of the axially aligned elements into the housing cavity; and thereafter any remaining one(s) of the selected are inserted into the housing cavity. In an example implementation, the predefined order comprises: the pole member, the permanent magnet; and the plate. In this example implementation, the act of applying the force comprises applying the force to the plate, whereby the force acts consecutively through the plate, the permanent magnet, and the pole member An example mode of the method further comprises inserting in order through the housing mouth the pole member, the counter flux generator, the stationary case member, the permanent magnet, and the plate.

This technology therefore provides an approach that combines both a "zero" air gap and mid air gap design to maximize the solenoid's magnetic efficiency while also providing a more consistent magnetic circuit when the metal components latch for improved solenoid performance, i.e. a higher magnetic latching force.

The technology provides, e.g.: 1) a more efficient magnetic circuit to increase the magnetic latching force; 2) a design that virtually eliminates all air gaps by employing an adjustable pole piece; and, 3) a robust, low-cost and easily assembled design with flexibility for various power levels, mounting schemes and output adaptors.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. That is, those skilled in the art will be able to devise various arrangements which, although not explicitly described or shown herein, embody the principles of the invention and are included within its spirit and scope. In some instances, detailed descriptions of well-known devices, circuits, and methods are omitted so as not to obscure the description of the present invention with unnecessary detail. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
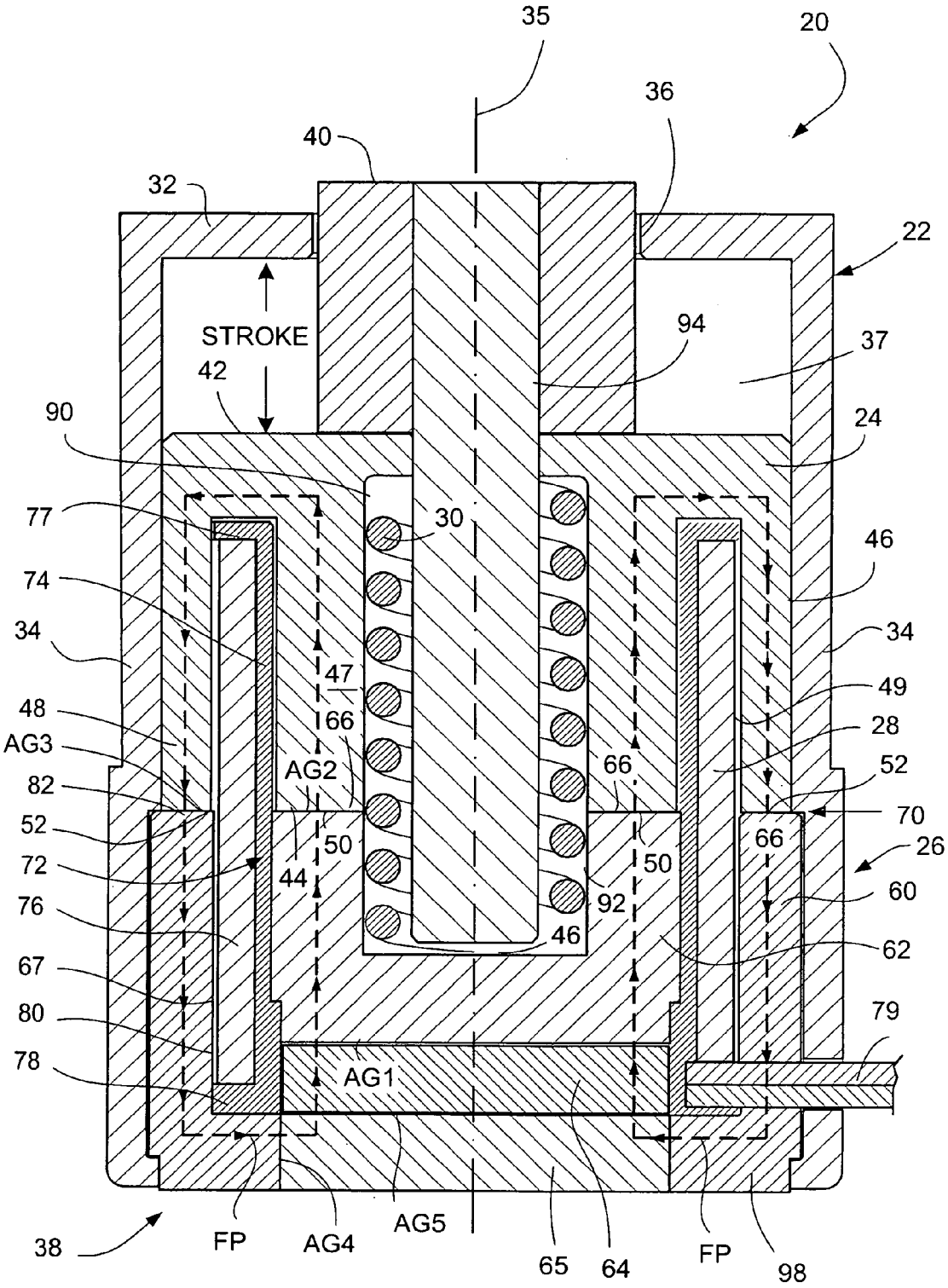
FIG. 1 is a cross sectioned view of a first example embodiment magnetic latching solenoid.
Figure 2:
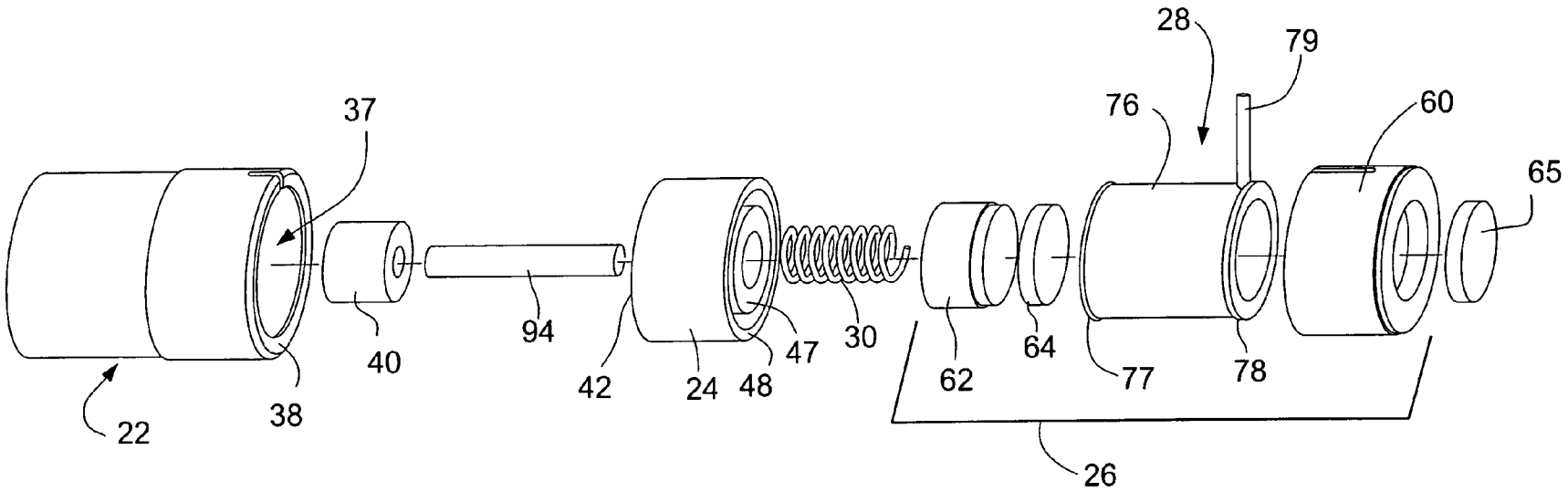
FIG. 2 is an exploded view of the example embodiment of FIG. 1.
Figure 3:
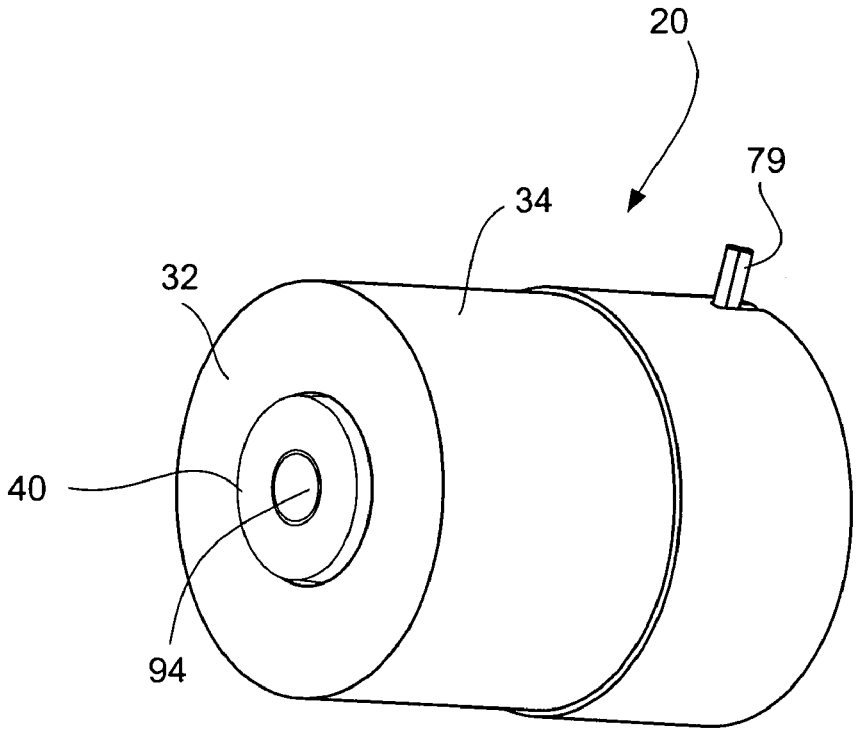
FIG. 3 is left end perspective view of the example embodiment of FIG. 1.
Figure 4:
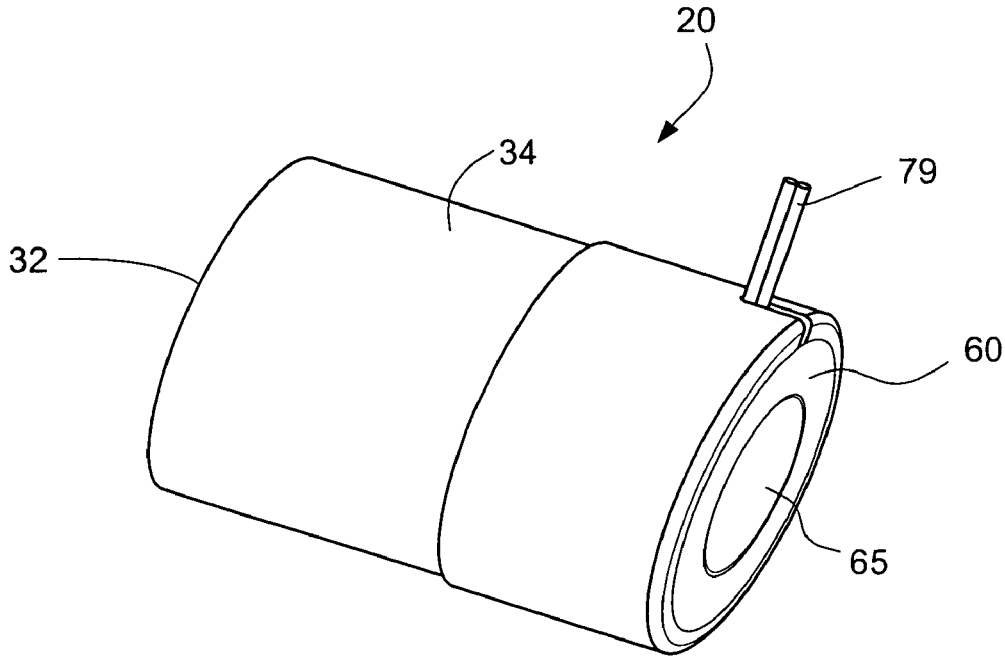
FIG. 4 is right end view perspective of the example embodiment of FIG. 1.

FIG. 1 shows a first example embodiment of magnetic latching solenoid 20. The magnetic latching solenoid 20 comprises housing 22, moveable magnetically permeable member 24, stationary magnetic assembly 26, counter flux generator 28; and, spring 30. FIG. 2 is an exploded view of the example embodiment of FIG. 1. FIG. 3 and FIG. 4 are respective left end perspective and right end perspective views of the example embodiment of FIG. 1 as assembled.

The housing 22 has an essentially hollow cylindrical shape defined by housing end wall 32 at a first housing end and by a circumferentially extending housing sidewall 34. The cylindrical volume defined by housing 22 has cylindrical axis 35. The housing end wall 32 has plunger aperture 36 extending there through along axis 35. The housing 22 thus at least partially defines a housing cavity 37 having an essentially open housing mouth 38.

The moveable magnetically permeable member 24 is configured to translate at least partially within housing 22 from a latched position to a stroked position along axis 35. FIG. 1 shows moveable magnetically permeable member 24 in its latched position in which moveable magnetically permeable member 24 is attracted to stationary magnetic assembly 26. The moveable member 24 comprises plunger 40, housing-confined shoulder surface 42, and one or more moveable mating surfaces which are represented as moveable mating surface 44. The moveable magnetically permeable member 24 has an essentially disk shape. An outer diameter of moveable magnetically permeable member 24 at peripheral sidewall 46 is of a dimension to enable moveable magnetically permeable member 24 to translate in housing cavity 37 along cylindrical axis 35 in sliding contact with the interior surface of housing sidewall 34. The upper and lower end walls of moveable magnetically permeable member 24, being transverse or orthogonal to cylindrical axis 35, comprise housing-confined shoulder surface 42 and moveable mating surface 44, respectively.

Plunger 40 is extendable through aperture 36 in the housing first end, e.g., in housing end wall 32. Plunger 40 can be integrally formed with moveable magnetically permeable member 24 or affixed or otherwise connected to moveable magnetically permeable member 24. The housing-confined shoulder surface 42 is contiguous to plunger 40 and lies at least partially in a first plane transverse to axis 35 when in the latched position. The housing-confined shoulder surface 42 is incapable of extending through, and does not extend through, aperture 36 in housing first end 32. Thus, housing-confined shoulder surface 42 has a greater extent than plunger 40 in the first plane in which moveable magnetically permeable member 24 lies.

The stroke range of plunger 40 is shown by the arrow labeled "Stroke". The extent of the stroke is defined by the volume in housing cavity 37 that exists between the inner wall of housing end wall 32 and the housing-confined shoulder surface 42 when the moveable magnetically permeable member 24 is in the latched position. Since this stroke range is dependent upon the geometry and sizing, the stroke range can vary according to application and user requirements.

In an example implementation, as seen from the perspective of stationary magnetic assembly 26 the moveable magnetically permeable member 22 comprises axially extending central portion 47 and axially extending peripheral portion 48. A toroid shaped moveable member cavity 49 is formed between axially extending central portion 47 and axially extending peripheral portion 48. As explained subsequently, moveable member cavity 49 is at least partially occupied by counter flux generator 28.

Since moveable magnetically permeable member 24 comprises both axially extending central portion 47 and axially extending peripheral portion 48, moveable mating surface 44 of moveable magnetically permeable member 24 actually comprises two moveable mating surfaces: a first moveable mating surface 50 provided on axially extending central portion 47 and a second moveable mating surface 52 provided on axially extending peripheral portion 48. Both first moveable mating surface 50 and second moveable mating surface 52 are annular rings (e.g., toroidal in shape), with the outer diameter of first moveable mating surface 50 being less than the inner diameter of second moveable mating surface 52. The moveable mating surface 44 (with its two components first moveable mating surface 50 and second moveable mating surface 52) lies at least partially in a second plane transverse to axis 35 when moveable magnetically permeable member 24 is in the latched position.

The moveable magnetically permeable member and members of the stationary magnetic assembly comprise a magnetic circuit for conducting magnetic flux. The members of the stationary magnetic assembly that comprise the magnetic circuit (known as stationary circuit members) include stationary case 60; stationary magnetically permeable member 62 (also known as pole member 62); permanent magnet 64, and plate 65.

The stationary magnetic assembly 26 is situated at least partially within housing 22 and thus in housing cavity 37. The stationary magnetically permeable member 62 comprises (on its top transverse wall) a central magnetized mating surface 66. A stationary cavity 67 is defined between an exteriorly positioned stationary case member 60 on the one side, and pole member 62 and permanent magnet 64 on an interior side.

The permanent magnet 64 generates a permanent magnetic flux field in stationary magnetically permeable member 26 and in moveable magnetically permeable member 24. The flux field generated by permanent magnet 64 is sufficient to retain moveable magnetically permeable member 24 essentially in contact with stationary magnetically permeable member 26 at an air gap interface 70 between stationary magnetically permeable member 26 and moveable magnetically permeable member 24 when in the latched position, e.g., the position shown in FIG. 1 in which a counter flux field is not applied to overcome the permanent magnetic flux field.

The stationary magnetically permeable member 62, i.e., pole member 62, is located between moveable magnetically permeable member 24 and permanent magnet 64 with respect to axis 35. Preferably, the axial extent of moveable magnetically permeable member 24 along axis 35 from shoulder surface 42 to moveable mating surface 44 is essentially the same as the axial extent of stationary magnetic assembly 26 (including stationary case 60, stationary magnetically permeable member 62, and permanent magnet 64) along axis 35. By "essentially the same" is meant that the axial extent of moveable magnetically permeable member 24 along axis 35 from shoulder surface 42 to moveable mating surface 44 is within twenty percent of an axial extent of stationary magnetic assembly 26 (including stationary case 60, stationary magnetically permeable member 62, and permanent magnet 64) along axis 35. That is, the axial extent of moveable magnetically permeable member 24 is essentially the same as the axial extent of the stationary magnetic assembly 26, plus or minus twenty percent.

As explained subsequently, the substantially equal extent of moveable magnetically permeable member 24 and stationary magnetic assembly 26 along cylindrical axis 35 results in air gap interface 70 being essentially mid-way between the opposite axial extremities of moveable magnetically permeable member 24 and stationary magnetic assembly 26, e.g., mid-way between housing-confined shoulder surface 42 of moveable magnetically permeable member 24 and the outer transverse surface of plate 65. Thus, the mid air gap interface 70 is located at essentially the halfway or midpoint of the complete magnetic circuit. The fact that the air gap is mid-way facilitates the flux path at air gap interface 70 as being essentially parallel to the direction of cylindrical axis 35, which (in the case of permanent magnet 64) provides a greater attracting or holding force by stationary magnetic assembly 26 for moveable magnetically permeable member 24. It is thus highly desirable, and accomplished by the present technology, to have the flux lines aligned at the air gap in an axial orientation, e.g., parallel to axis 35. When the axial extent of moveable magnetically permeable member 24 (along axis 35 from shoulder surface 42 to moveable mating surface 44) is more than twenty percent of an axial extent of stationary magnetic assembly 26, the attracting or holding force of the permanent magnet is diminished by more than five percent. Thereafter there is increasing diminished holding force with increasingly larger discrepancies of axial extents of the magnetically permeable member and the stationary magnetic assembly. When the axial extent of moveable magnetically permeable member 24 (along axis 35 from shoulder surface 42 to moveable mating surface 44) is within ten percent of an axial extent of stationary magnetic assembly 26, the attracting or holding force is diminished by about one percent or less.

The counter flux generator 28 of the magnetic latching solenoid 20 of FIG. 1 comprises bobbin 72. The counter flux generator 28. e.g., bobbin 72, is positioned at least partially in moveable member cavity 49 and at least partially in stationary cavity 67, the moveable member cavity 49 and stationary cavity 67 being axially aligned and sized to receive bobbin 72. The bobbin 72 has an essentially hollow cylindrical shape and as such has axially extending bobbin cylinder wall 74 about which a coil of wiring 74 is exteriorly wound. The coil 76 is captured between bobbin upper transverse flange 77 and bobbin lower transverse flange 78. The coil 76 terminates in a lead wires 79 or the like which extends radially through a port in stationary case 60 and housing sidewall 34.

As explained above, stationary magnetically permeable assembly 26 comprises, e.g., stationary case member 60 and pole member 62, e.g., stationary magnetically permeable member 62. The stationary case 60 has an interior wall which at least partially defines case cavity 80. On its upper end the stationary case 60 comprises peripheral magnetized mating surface 82. Thus, in the example embodiment of FIG. 1, stationary magnetically permeable assembly 26 comprises two magnetized mating surfaces, i.e., central magnetized mating surface 66 and peripheral magnetized mating surface 82.

As explained in more detail below, pole member 62 is configured for selective positioning within case cavity 80 and along axis 35, and thereby provides magnetized mating surface 50 independently positionable relative to magnetized mating surface 66 along axis 35. In an example implementation, at least portions of counter flux generator 28, pole member 62, and permanent magnet 64 are transversely interior to stationary case member 60. In other words, as shown in FIG. 1, the positioning of magnetized mating surface 50 along the axis 35 is dependent only on the location of the movable magnetic mating surface 44.

Spring 30 is configured to bias moveable magnetically permeable member 24 away from stationary magnetically permeable assembly 26 when a counter flux generated by counter flux generator 28 overcomes the permanent magnetic flux generated by permanent magnet 64. In the embodiment shown in FIG. 1, spring 30 is retained partially in a central cavity 90 of moveable magnetically permeable member 24 (at the center of axially extending central portion 47) and retained partially in a central cavity 92 of stationary magnetically permeable member 62. The central cavity 90 and central cavity 92 are aligned in the direction of cylindrical axis 35. Further, in the example embodiment of FIG. 1, spring 30 surrounds plunger guide post 94. The plunger guide post 94 extends centrally through plunger 40 and is centrally rooted in moveable magnetically permeable member 24, and in particular in axially extending central portion 47.

As shown in the example embodiment of FIG. 1, the housing mouth 38 of housing cavity 37 is essentially open opposite the housing first end, e.g., opposite housing end wall 32. The magnetic latching solenoid 20 of FIG. 1 further comprises plate 65. The plate 65 has a major dimension which is transverse to axis 35. After insertion of the permanent magnet 64 into housing cavity 37, insertion of plate 65 into housing cavity 37 provides a transverse end surface that (in the illustrated embodiment) happens to be flush with the transversely extending flange 98 of stationary case 60. The flushness of plate 65 is not critical, as the end of the solenoid can have differing configurations in differing embodiments. Plate 65 is significant in, e.g., being one of the elements that comprises the stationary circuit necessary for conducting the magnetic flux. The plate 65 is thus the last element to be inserted into housing cavity 37 for completing the magnetic circuit and, in the illustrated embodiment, to close completely housing mouth 38, after various components of magnetic latching solenoid 20 have been inserted into housing cavity 37 in a manner such as that hereinafter described. Thus, housing 22 and plate 65 are configured whereby moveable magnetically permeable member 24, case member 60, permanent magnet 64, and plate 65 can be axially aligned in this order within a volume defined by housing 22 and the plate 65.

FIG. 1 thus shows a cross-sectional view of magnetic latching solenoid 20 and also illustrates magnetic flux path FP. With moveable magnetically permeable member 24 latched against stationary magnetic assembly 26, the spring 30 is compressed and the magnetic flux that originates from permanent magnet 64 "circulates" through the metal components as shown by the arrows labeled FP. Whereas typical magnetic latching solenoids have their primary air gap (interface between the moving and stationary component(s)) near the end of the solenoid, e.g., closer to housing end wall 32, in the present technology the primary air gap 70 is located in the middle of the solenoid (e.g., in the middle of the metallic and magnetically permeable components comprising moveable magnetically permeable member 24 and stationary magnetic assembly 26 as explained above), thereby allowing for a more efficient magnetic circuit.

FIG. 1 also identifies five important interfaces between mating components, i.e., interfaces at which air gaps need to be minimized (since air gaps reduce the magnetic efficiency of the solenoid). These five air gaps are labeled as AG1-AG5, respectively. A first air gap (AG1) is between permanent magnet 64 and pole member 62. A second air gap (AG2) is between moveable mating surface 50 of axially extending central portion 47 of moveable magnetically permeable member 24 and magnetized mating surface 66 of pole member 62. A third air gap (AG3) is between second moveable mating surface 52 of axially extending peripheral portion 48 of moveable magnetically permeable member 24 and second magnetized mating surface 82 of stationary case 60. A fourth air gap (AG4) is between the axially extending surfaces of stationary case 60 (which, e.g., define case cavity 80) and elements within case cavity 80, e.g., plate 65. A fifth air gap (AG5) is between plate 65 and permanent magnet 64.

Thus, as seen in FIG. 1, the two air gap interfaces AG2 and AG3 extend in a radial direction which is orthogonal to axis 35. The two air gap interfaces AG2 and AG3 are spaced apart from one another in the radial direction. The two air gap interfaces AG2 and AG3 are separated in the radial direction by the counter flux generator 28.

A challenge with a mid air gap solenoid is the air gap interface 70 between moveable magnetically permeable member 24 and stationary magnetic assembly 26. In the example double ring configuration illustrated in FIG. 1, air gap interface 70 actually comprises two air gaps: air gap AG2 (between moveable mating surface 50 of axially extending central portion 47 of moveable magnetically permeable member 24 and magnetized mating surface 66 of pole member 62) and air gap AG3 (between second moveable mating surface 52 of axially extending peripheral portion 48 of moveable magnetically permeable member 24 and second magnetized mating surface 82 of stationary case 60). That is, the mating surface for both moveable magnetically permeable member 24 and stationary magnetic assembly 26 comprise both an outer ring and an inner ring that contact each other's surface respectively and simultaneously. The flatness between the outer ring and the inner ring's surface for each component contributes to a potential air gap of several thousandths of an inch, which can significantly degrade the magnetic efficiency of the solenoid. This technology eliminates that concern by having an adjustable pole piece 62 centrally located within stationary magnetic assembly 26. The ability to independently locate pole member 62 ensures contact with the inner ring of moveable magnetically permeable member 24 (e.g., moveable mating surface 50 of axially extending central portion 47) during the build process. The build process, e.g., a method for making a magnetic latching solenoid, is described further herein. The contact at air gap AG3 between the outer rings of moveable magnetically permeable member 24 and stationary magnetic assembly 26 is also ensured during the build process. Thus the air gaps associated with the mid air gap solenoid have been virtually eliminated.

Figure 5:
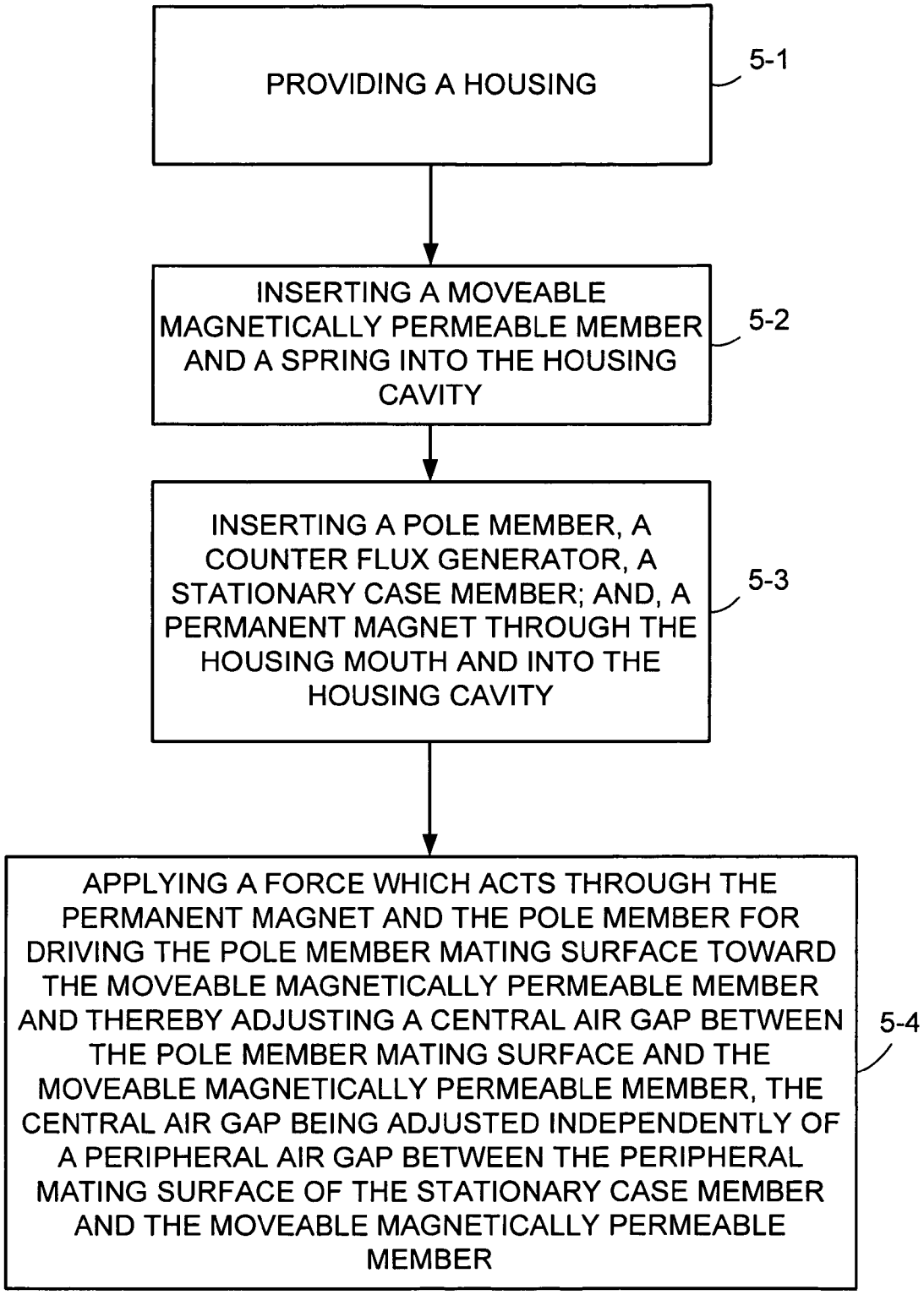
FIG. 5 is a flowchart depicting representative, basic acts or steps comprising a method of making a magnetic latching solenoid.

Another aspect of the technology includes a method of making a magnetically latched solenoid, e.g., a solenoid build process. Basic acts or steps comprising the method are illustrated in simplified, representative fashion in FIG. 5. Although the method of FIG. 5 is discussed in context of the structure of the example embodiment of FIG. 1, it will be appreciated that the method is not limited to the FIG. 1 embodiment but also encompasses other embodiments such as those also illustrated or otherwise embraced herein.

Act 5-1 depicts providing a housing, such as housing 22. As indicated previously, in one example illustrated embodiment housing 22 comprises housing end wall 32 provided with plunger aperture 36. The housing 22 at least partially defines housing cavity housing cavity 37 through which axis 35 extends. The housing cavity 37 is essentially open opposite housing first end 32, e.g., comprises an essentially open housing mouth 38.

The method also includes, as act 5-2, inserting, into housing cavity 37, the moveable magnetically permeable member 24 and spring 30. In one example illustrated embodiment moveable magnetically permeable member 24 comprises the axially extending central portion 47 and the axially extending peripheral portion 48. A moveable member cavity 49 is defined between the axially extending central portion 47 and axially extending peripheral portion 48.

The method further includes, as act 5-3, inserting, through housing mouth 38 and into the housing cavity 37, the following: pole member 62, counter flux generator 28, stationary case member 60; and, permanent magnet 64. In the example embodiment of FIG. 1 as particularly illustrated, pole member 62 comprises pole member mating surface(s) (e.g., magnetized mating surface 66 and magnetized mating surface 82). The counter flux generator 28 is inserted at least partially into the moveable member cavity 49. The stationary case member 60 at least partially defines a case cavity 80 and comprises the peripheral magnetized mating surface 82. Upon insertion of the stationary case member 60, the case cavity 80 is occupied at least partially by the counter flux generator 28 and pole member 62.

The method also includes, as act 5-4, applying a force which acts (axially) on pole member 62 for driving pole member mating surface (e.g., magnetized mating surface 66) toward moveable magnetically permeable member 24, and thereby adjusting central air gap AG2 between pole member mating surface 66 and moveable magnetically permeable member 24. The application of the force of act 5-4 serves to adjust the central air gap AG2 independently of the peripheral air gap AG3 which exists between peripheral mating surface 82 of stationary case member 60 and moveable magnetically permeable member 24.

In one example embodiment and mode of the method of FIG. 5 (illustrated for example by FIG. 1), the method comprises inserting certain elements through the housing mouth in a predefined order. These elements happened to be axially aligned along axis 35 and each also comprises the magnetic circuit (it being understood that other elements such as stationary case 60 and moveable magnetically permeable member 24 also comprise the magnetic circuit). The certain elements which are inserted in the predefined order are pole member 62, permanent magnet 64, and plate 65. The force of act 5-4 is applied to a selected one of these (e.g., axially aligned) elements upon insertion of the selected one of the axially aligned elements into the housing cavity; and thereafter any remaining one(s) of the selected are inserted into the housing cavity.

In an example implementation, the predefined order comprises: pole member 62, permanent magnet 64; and plate 65. In this example implementation, act 5-4 of applying the force comprises applying the force to the plate 65, whereby the force acts consecutively through the plate 65, permanent magnet 64, and pole member 62. In other implementations, the force of act 5-4 can be applied upon pole member 62 essentially immediately after insertion of pole member 62, with insertion of permanent magnet 64 and plate 65 then following. In yet other implementations, the force of act 5-4 can be applied upon permanent magnet 64, with insertion of plate 65 then following.

An example mode of the method further comprises the optional act of inserting, through housing mouth 38 and into housing cavity 37 after insertion of the permanent magnet 64, an end plate 65, and thereby substantially closing housing mouth 38. After insertion of the plate 65 the force of act 5-4 is applied to plate 65 instead of to permanent magnet 64, whereby the force acts consecutively through plate 65, the permanent magnet 64, and the pole member 62 for adjusting the position of stationary magnetically permeable member 62 along axis 35 and its magnetized mating surface 66.

Another example mode of the method further comprises a particular order of inserting components through housing mouth 38. In particular, as an optional feature the method can comprise inserting in order through housing mouth 38: pole member 62; counter flux generator 28; stationary case 60; and permanent magnet 64.

Thus, in various embodiments illustrated herein, pole member 62 is located between moveable magnetically permeable member 24 and permanent magnet 64 with respect to axis 35. The pole member 62 comprises a configuration for being selectively positioned through housing mouth 38 and within case cavity 80 along the axis whereby the central magnetized mating surface 66 is positionable along axis 35 relative to moveable magnetically permeable member 24 in a manner that is independent of the axial positioning of the peripheral magnetized mating surface 82 provided on stationary case 60.

As explained by the method, the air gaps such as air gap AG2 and air gap AG3 associated with the mid air gap solenoid have been virtually eliminated. The potential for air gaps at the remaining component interfaces has also been virtually eliminated. For example, during the build process assembly method, permanent magnet 64 is placed in direct contact with pole member 62 and, due to its magnetic attraction, results in virtually no air gap at air gap AG1. Also, during the build process assembly method, the outer diameter of the plate 65 is pressed into the inner diameter of a through hole (e.g., case cavity 80) in stationary case 60, resulting in virtually no air gap at air gap AG4. Moreover, during the build process assembly method, plate 65 is pressed into the hole (case cavity 80) in stationary case 60 until it contacts permanent magnet 64, resulting in virtually no air gap at air gap AG1. Thus, one of the several benefits of the technology is that, when the solenoid is completely assembled, the inherent air gaps of traditional magnetic latching solenoids designs have been virtually eliminated.

Traditional magnetic latching solenoids also tend to have variations in the release power supplied by the coil to unlatch the moveable metal component from the stationary component. The primary source of this variation is the inability of the moveable component to repeatedly re-latch against the stationary component in the same position and orientation. The resulting variations in air gaps and magnetic circuits then cause the release power to vary beyond application requirements. But with the present technology, the moveable magnetically permeable member 24 has a very good bearing surface along the inner surface of housing sidewall 34. The housing sidewall 34 is preferably of plastic, and in smooth fashion guides moveable magnetically permeable member 24 toward stationary magnetic assembly 26 during the re-latching process. Thereby, when moveable magnetically permeable member 24 contacts stationary magnetic assembly 26, the contact surfaces between the two components are in consistent and substantial contact area, which reduces release power variations.

Figure 6:
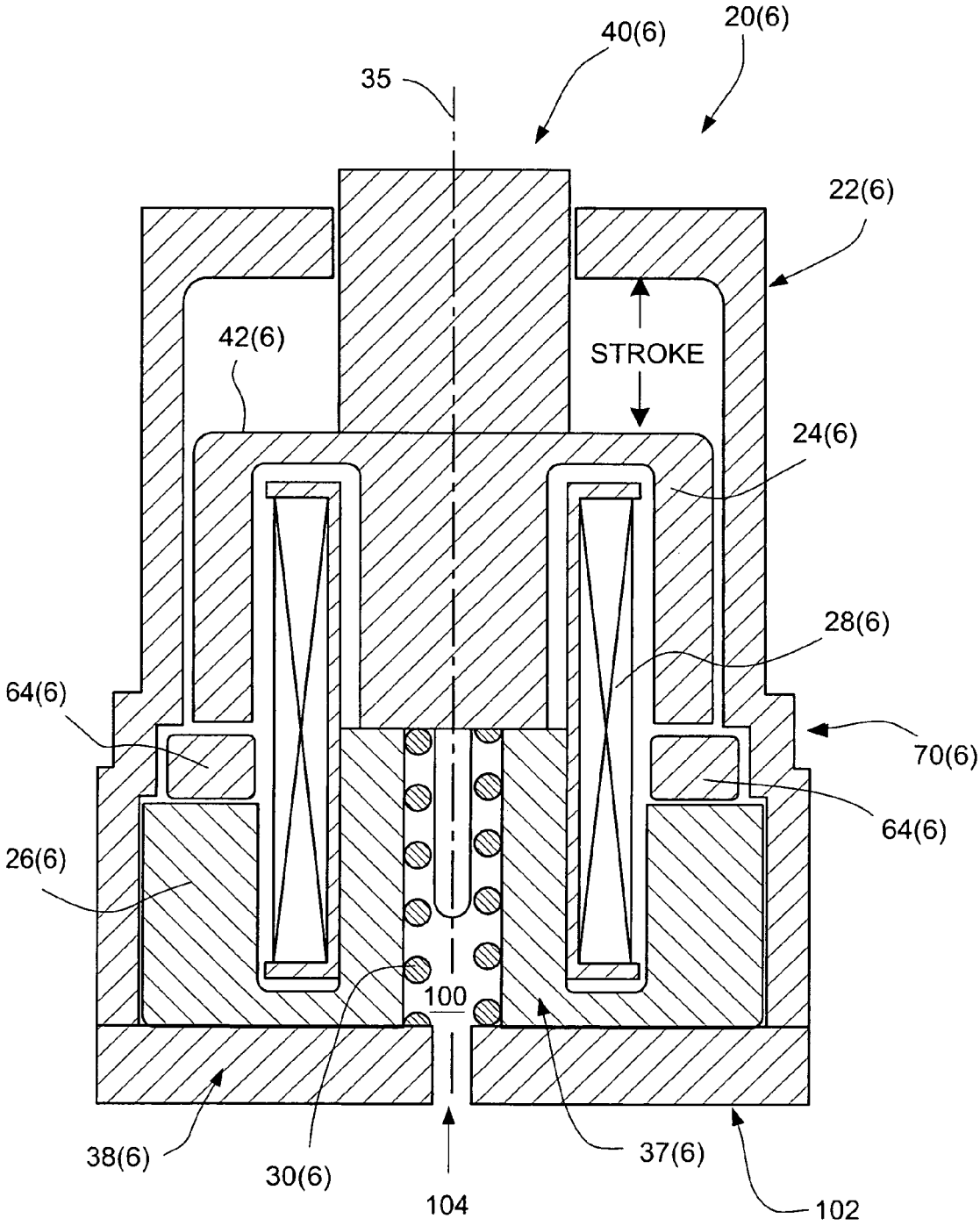
FIG. 6 is a cross sectioned view of another example embodiment magnetic latching solenoid.

FIG. 6 through and including FIG. 13 illustrate other example embodiments which in differing ways and to differing extends implement one or more aspects (but not necessarily all aspects) of the technology of the example embodiment of FIG. 1. In each of FIG. 6 through and including FIG. 13, as well as other figures hereinafter described, similar reference numerals are utilized for components or parts that are similar to those of the example embodiment of FIG. 1. In some instances, alphabetical or numerical suffixes are appended to the reference numerals for sake of distinguishing the component or part from a similar component of FIG. 1. Common aspects or similarities of the magnetic latching solenoids of FIG. 6 through and including FIG. 13 may not be described in detail below, explanation instead primarily being provided for variant or other distinctive aspects or features.

The magnetic latching solenoid 20(6) of FIG. 6 has a mid air gap 70(6) in a manner similar to the example embodiment of FIG. 1. In particular, air gap interface 70(6) is essentially mid-way between the opposite axial extremities of moveable magnetically permeable member 24(6) and stationary magnetic assembly 26(6), e.g., mid-way between housing-confined shoulder surface 42(6) of moveable magnetically permeable member 24(6) and the outer transverse extreme surface of stationary magnetic assembly 26(6), e.g., of the stationary case. The magnetic latching solenoid 20(6) of FIG. 6 also differs from magnetic latching solenoid 20 of FIG. 1 in several ways. As a first example difference, permanent magnet 64(6) of magnetic latching solenoid 20(6) has an essentially torodial shape and is situated near air gap interface 70(6). In fact, permanent magnet 64(6) is seated on a notched upper surface of stationary magnetic assembly 26(6) and is thereby situated on an outer upper periphery of stationary magnetic assembly 26(6) between stationary magnetic assembly 26(6) and moveable magnetically permeable member 24(6). As a further example, spring 30(6) is provided in a central interior cavity 100 of stationary magnetic assembly 26(6). The housing mouth 38(6) of housing cavity 37(6) is closed by housing cover 102. The housing cover 102 has a central access hole 104. The spring 30(6) has a first end retained at an intersection of housing cover 102 and stationary magnetic assembly 26(6), and has a diameter greater than that of central access hole 104. A second end of spring 30(6) bears against the axially extending central portion of moveable magnetically permeable member 24(6).

Figure 7:
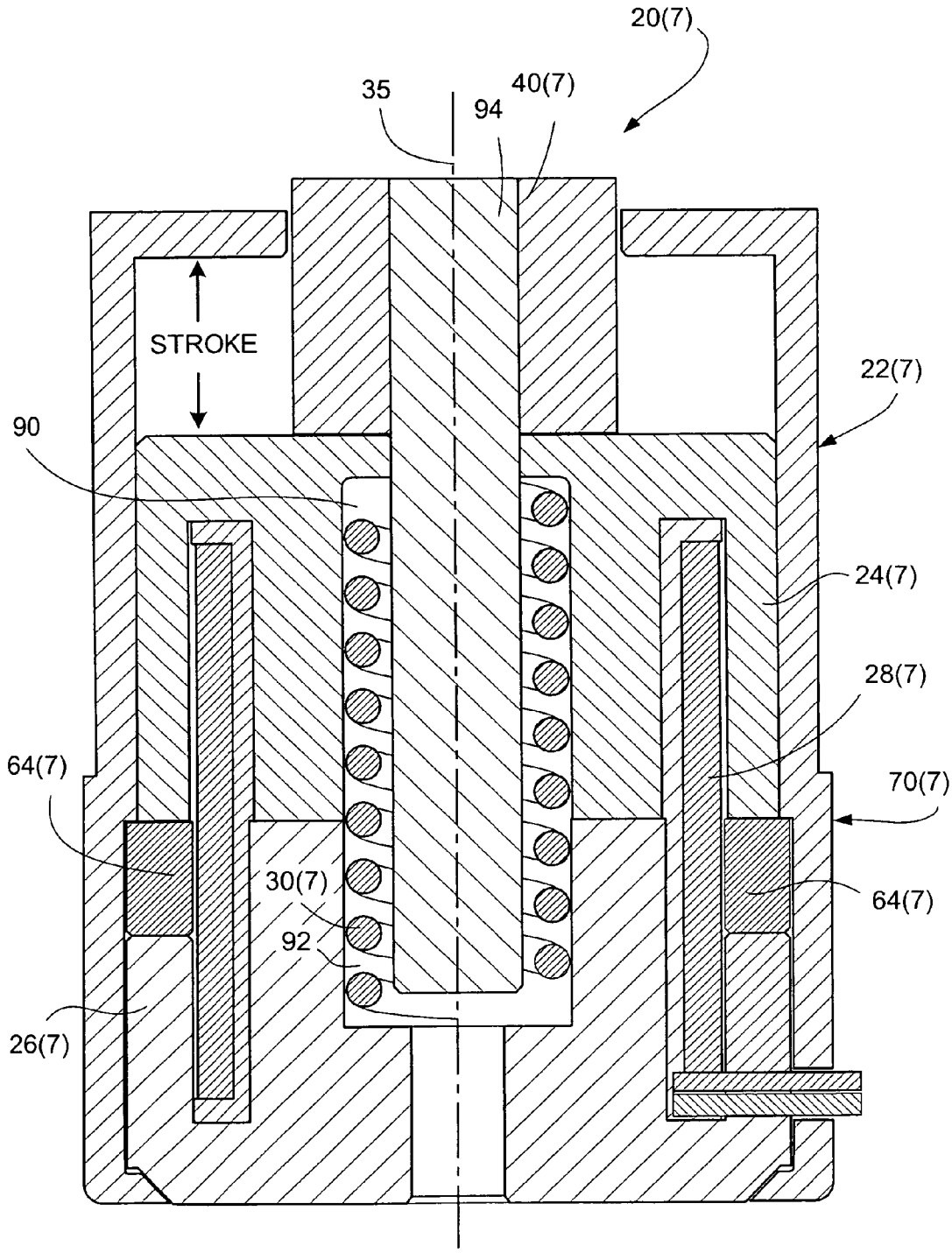
FIG. 7 is a cross sectioned view of another example embodiment magnetic latching solenoid.

The magnetic latching solenoid 20(7) of FIG. 7 also has a mid air gap 70(7) in a manner similar to the example embodiment of FIG. 1, and a permanent magnet 64(7) positioned analogous to permanent magnet 64(6) of the embodiment of FIG. 6. However, in the example embodiment of FIG. 7, the spring 30(7) is retained in a similar manner to spring 30 of FIG. 1. That is, spring 30(7) is retained partially in a central cavity 90 of moveable magnetically permeable member 24(7) and retained partially in a central cavity 92 of stationary magnetically permeable member 26(7). The central cavity 90 and central cavity 92 are aligned in the direction of cylindrical axis 35. Also in the example embodiment of FIG. 7 the spring 30(7) surrounds plunger guide post 94, which in turn extends centrally through plunger 40(7) and is centrally rooted in moveable magnetically permeable member 24(7).

Figure 8:
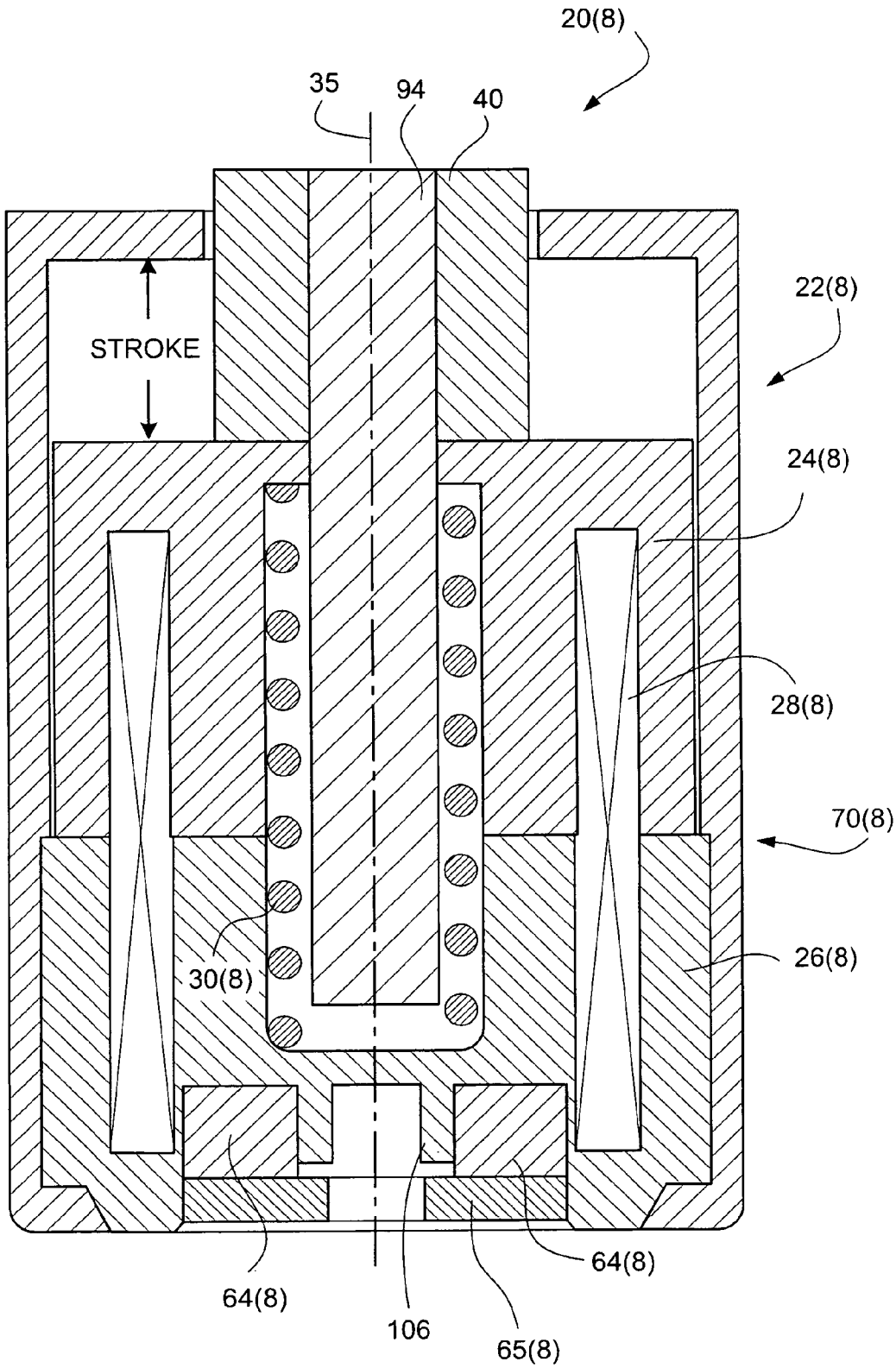
FIG. 8 is a cross sectioned view of another example embodiment magnetic latching solenoid.

The magnetic latching solenoid 20(8) of FIG. 8 also has a mid air gap 70(8) in a manner similar to the example embodiment of FIG. 1. Moreover, permanent magnet 64(8) is positioned analogous to permanent magnet 64 of the embodiment of FIG. 1. However, permanent magnet 64(8) of FIG. 8 is toroidal in shape rather than a solid disk. The permanent magnet 64(8) is retained in position in an annular cavity of stationary magnetic assembly 26(8). The annular cavity is defined by an axially extending retaining ring 106. The permanent magnet 64(8) is further retained in the annular cavity by annular-shaped plate 65(8).

Figure 9:
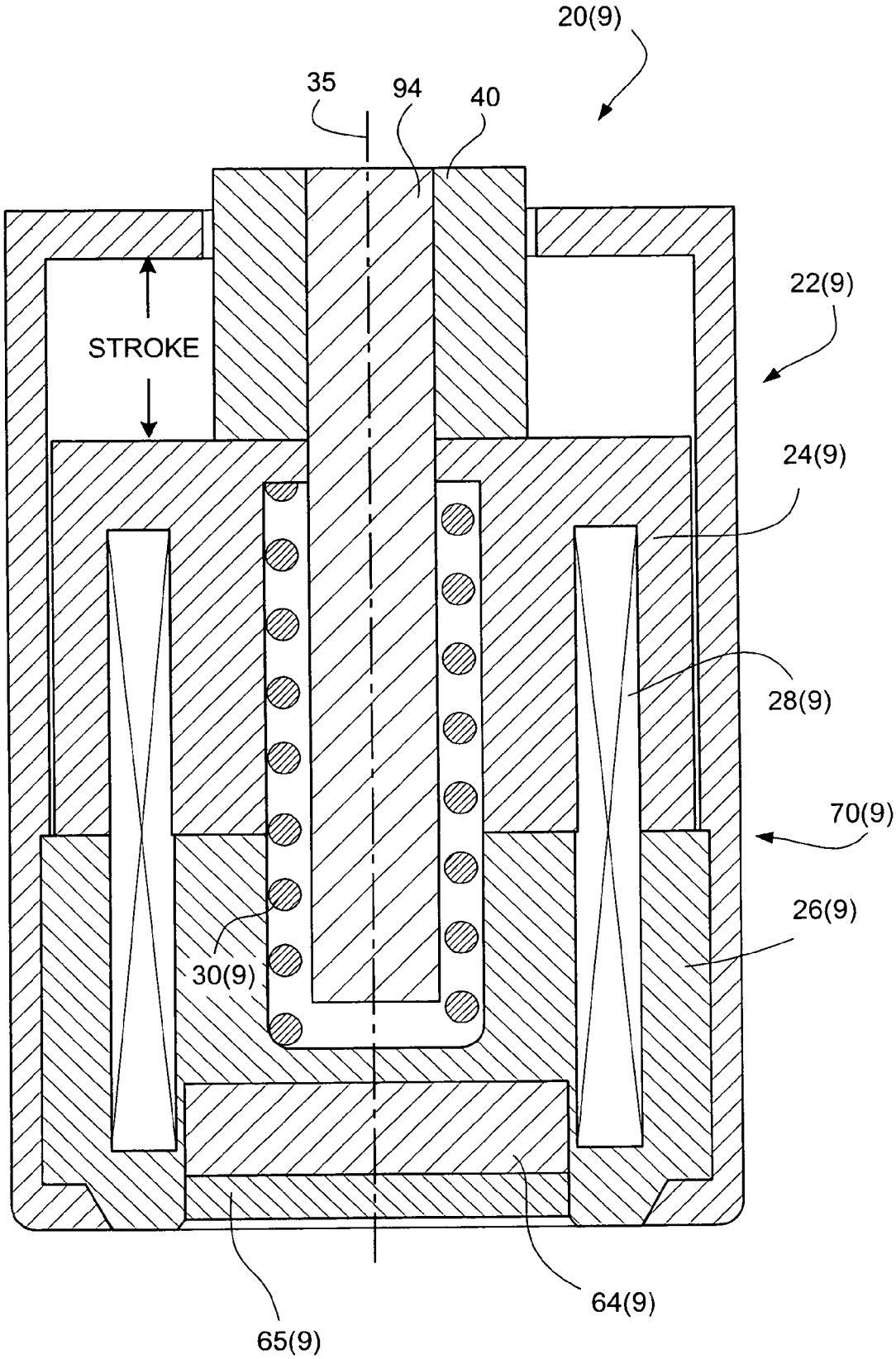
FIG. 9 is a cross sectioned view of another example embodiment magnetic latching solenoid.

The magnetic latching solenoid 20(9) of FIG. 9 resembles that of FIG. 8, but differs primarily in that permanent magnet 64(9) is disk-shaped (like permanent magnet 64 of FIG. 1). The permanent magnet 64(9) is further retained in the annular cavity by disk shaped plate 65(9), like plate 65 of the FIG. 1 embodiment.

Figure 10:
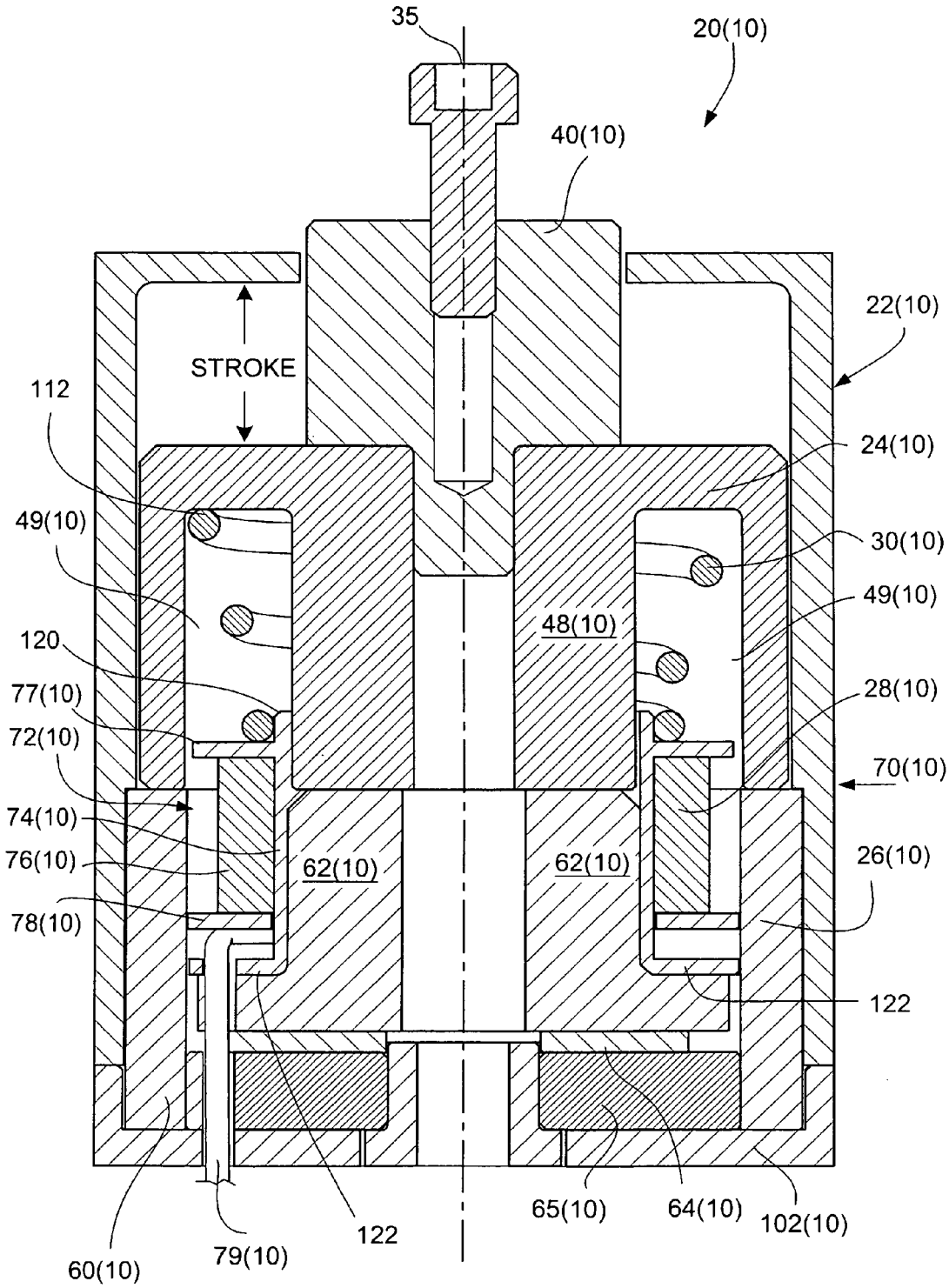
FIG. 10 is a cross sectioned view of another example embodiment magnetic latching solenoid.

The magnetic latching solenoid 20(10) of FIG. 10 resembles that of FIG. 1, in having, e.g., a mid air gap 70(10) (in a manner similar to the example embodiment of FIG. 1, as well as an adjustable pole member 62(10). Primary differences of the magnetic latching solenoid 20(10) of FIG. 10 involve the configuration and nature of retention of spring 30(10); the structure of counter flux generator 28(10); and structure which facilitates provision of separate flux paths for the coil flux (the flux generated by counter flux generator 28(10)) and the flux of permanent magnet 64(10).

The type and location of the spring which separates the two metal components of a magnetic latching solenoid when the solenoid unlatches can be a source of release power variation. Springs with open ends (e.g., pointed ends) tend to push the moving metal component away from the stationary metal component at an angle rather than perpendicular since the two pointed ends of the spring do not apply a force directly on the centerline of each component or in a direction that is parallel with the direction of separation.

Figure 11:
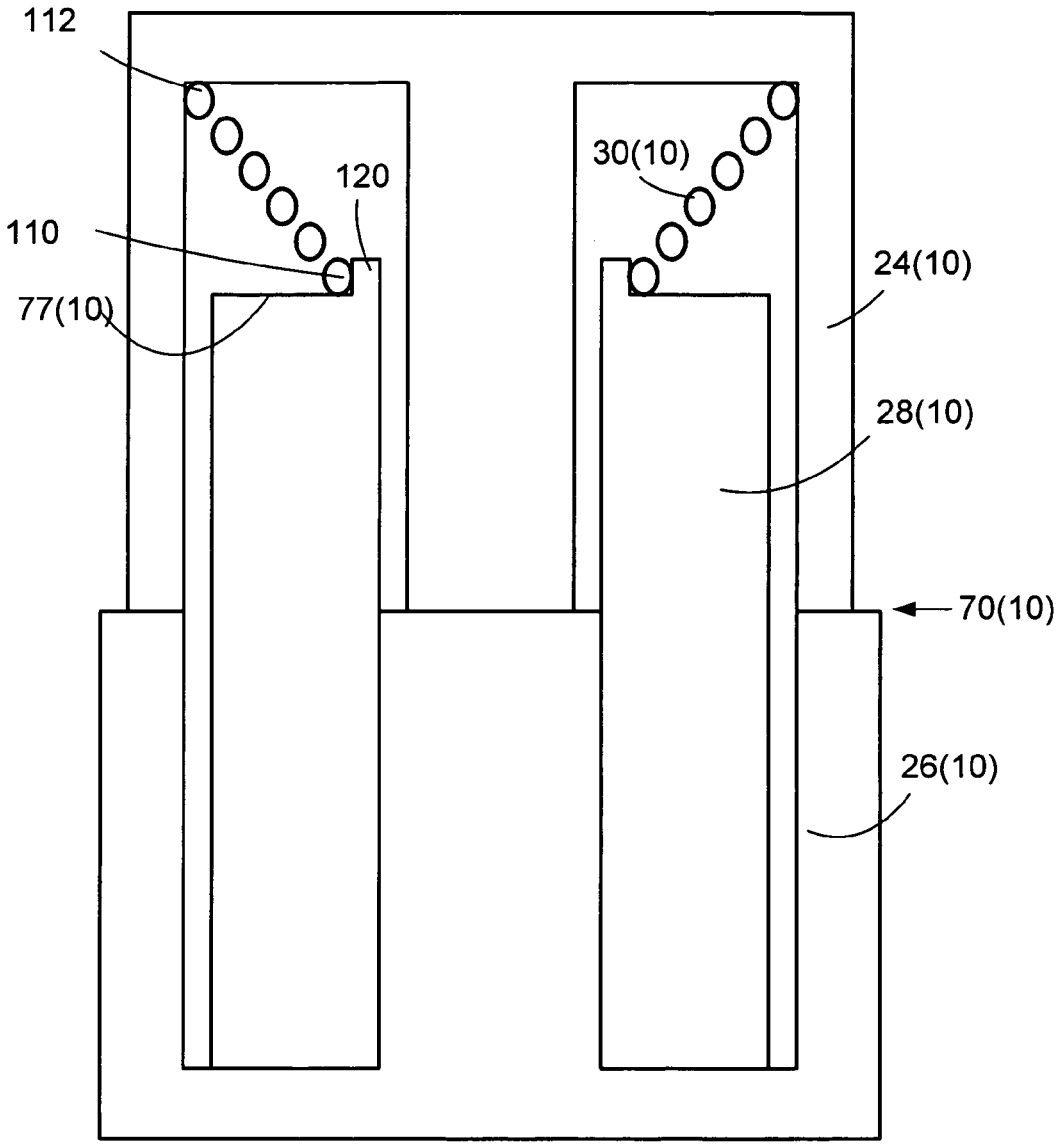
FIG. 11 is a cross sectioned schematic view of the example embodiment magnetic latching solenoid of FIG. 10, showing selected components advantageous for illustrating structure and retention of a conical spring thereof.

As shown in FIG. 10 and illustrated schematically in FIG. 11, spring 30(10) comprises a conical spring situated in the moveable member cavity 49(10). The conical spring has a first end coil 110 (an essentially closed loop) lying in a first spring end plane and a second end coil 112 (an essentially closed loop) lying in a second spring end plane (see FIG. 11). The second end coil 112 has a greater diameter than the first end coil 110. One end coil of spring 30(10) bears against and contacts a radially extending interior surface of the moveable magnetically permeable member 24(10); the opposite end coil of spring 30(10) bears against and contacts the bobbin 72(10), as explained below.

Having both spring ends 110, 112 being closed and geometrically grounded applies a more uniform force to the metal components that is more in line with the direction of separation and has a larger "circular" imprint on the moving metal component as compared to the typically used and centrally located standard straight compression spring. This approach not only reduces release power variation but also reduces the average release power because the metal parts separate more "efficiently." The spring 30(10) thereby applies a uniform force with a "circular" imprint having a larger diameter (at second end coil 112) and more stably and uniformly drives the moving metal component (e.g., moveable magnetically permeable member 24(10)) away from the stationary metal component (e.g., stationary magnetic assembly 26(10)).

In the example implementation of FIG. 10, flux generator 28(10) comprises bobbin 72(10). The bobbin 72(10) comprises bobbin frame which in turn comprises bobbin cylinder wall 74(10), bobbin upper transverse flange 77(10), and bobbin lower transverse flange 78(10) similar to that previously described with reference to FIG. 1. In addition, for the example embodiment of FIG. 10, bobbin 72(10) comprises axially extending bobbin flange 120. The axially extending bobbin flange 120 intersects bobbin upper transverse flange 77(10), and both axially extending bobbin flange 120 and bobbin upper transverse flange 77(10) extend into moveable member cavity 49(10).

In the particular example embodiment illustrated in FIG. 10 (and as shown in more detail by FIG. 11), first end coil 110 of spring 30(10) is separated from the moveable magnetically permeable member 24(10) by the axially extending bobbin flange 120, and is advantageously retained at the intersection of axially extending bobbin flange 120 and bobbin upper transverse flange 77(10). The second end coil 112 contacts a radially extending interior surface of the moveable magnetically permeable member 24(10), e.g., a radially extending interior surface that at least partially defines moveable member cavity 49(10). It will be appreciated, however, that in an alternate embodiment or variation that conical spring 30(10) can be inverted with respect to its position shown in FIG. 10 and FIG. 11, so that in the alternate variation of first end coil 110 of spring 30(10) bears against the radially extending interior surface of the moveable magnetically permeable member 24(10) and the larger diameter second end coil 112 contacts and bears against the bobbin flange 120 and bobbin upper transverse flange 77(10).

Thus, the structure of counter flux generator 28(10) differs from that of the example embodiment of FIG. 1 in having, e.g., axially extending bobbin flange 120 for accommodating conical spring 30(10). The counter flux generator 28(10) also differs in having bobbin second lower transverse flange 122. The bobbin second lower transverse flange 122 is parallel to and below bobbin lower transverse flange 78(10). As further shown in FIG. 10, lead wires 79(10) which supplies electrical current to coil 76(10) extends between bobbin lower transverse flange 78(10) and bobbin second lower transverse flange 122, through an axial aperture in bobbin second lower transverse flange 122, axially alongside or proximate the periphery of permanent magnet 64(10), through an axial hole in plate 65(10), and though an axial port in housing cover 102(10).

For some applications, it is necessary to minimize the release time for a magnetic latching solenoid to unlatch, e.g. the time from applying power to the solenoid coil in a latched condition to the time when the moving member unlatches, strokes and then reaches the end of its travel. An example of this is application is for circuit breakers which must quickly react to a signal triggered by an overcurrent circuit condition. Quick release times can prevent or minimize catastrophic property damage. When a magnetic latching solenoid is used in this capacity, release times around 5 mSec or less must be achieved.

Figure 12:
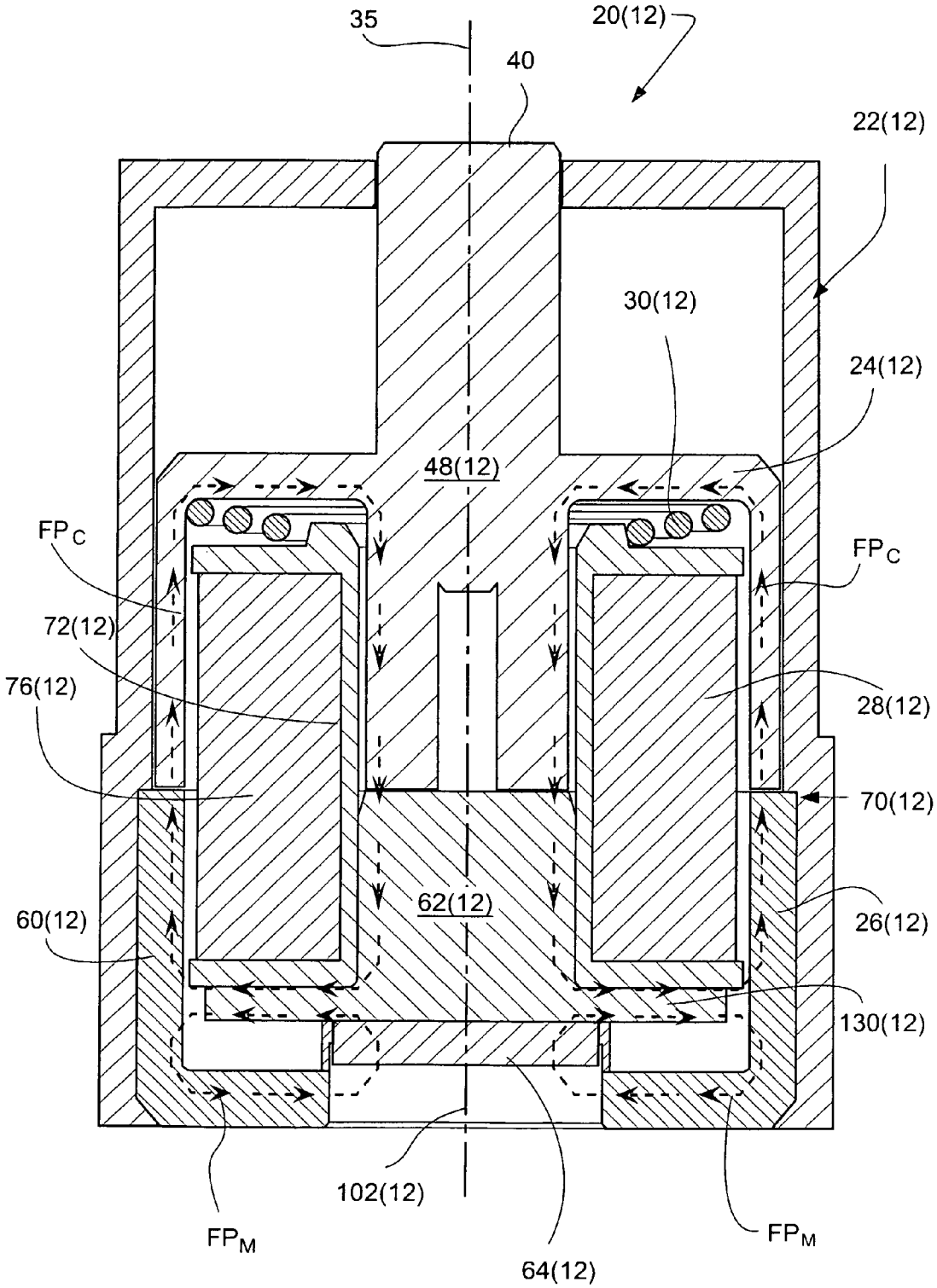
FIG. 12 is a cross sectioned view of another example embodiment magnetic latching solenoid.

The primary elements that affect release time are the inductance of the coil and solenoid geometry, the mass of the moving member, and the ability of the coil's magnetic flux to become "established" in the magnetic circuit of the solenoid when the coil is energized. The magnetic latching solenoid 20(12) of the example embodiment of FIG. 12 shows not only how a conical spring 30(12) might be packaged into a magnetic latching solenoid, but also shows how a metal pole piece 62(12) can be modified to include a large transversal flange 130(12) on one end. The dual flux path-facilitating flange 130 creates a "parallel flux path" to "conduct" both the flux of permanent magnet 64(12) [simplistically indicated by flux path $FP_M$ in FIG. 12] and the magnetic flux of coil 76(12) [simplistically indicated by flux path $FP_C$ in FIG. 12] when coil 76(12) is energized. The dual flux path-facilitating flange 130(12) is in the form of an enlarged annular rim on the periphery of pole member 62(12), and in the axial direction extends below bobbin 72(12) and air gap about which the flux of permanent magnet travels. An air gap is provided between the outer diameter of the dual flux path-facilitating flange 130(12) of pole piece 62(12) and the inner diameter of the stationary case 60(12) and affects/determines the hold force, and thus the release time.

The parallel flux paths allows the magnet's flux to be diverted through an alternative flux path $FP_M$ once the coil is energized and also allows the coil's flux to become established through a path $FP_C$ other than through the permanent magnet 64(12). Although showing all the flux lines is too complex to depict in FIG. 12, the net result is that the coil's flux is quickly established due to the presence of the parallel path $FP_M$. As a result, the net attractive force between moveable magnetically permeable member 24(12) and stationary magnetic assembly 26(12) rapidly decreases and the spring force quickly pushes the moveable magnetically permeable member 24(12) away from the stationary magnetic assembly 26(12) to the end of travel position for moveable magnetically permeable member 24(12). Thus, magnetic latching solenoid 20(12) of the example embodiment of FIG. 12 also features a response enhancement feature, e.g. a feature that facilitates dual flux paths (separate flux paths for the coil flux (the flux generated by counter flux generator 28(12)) and the flux of permanent magnet 64(12)).

Figure 13A:
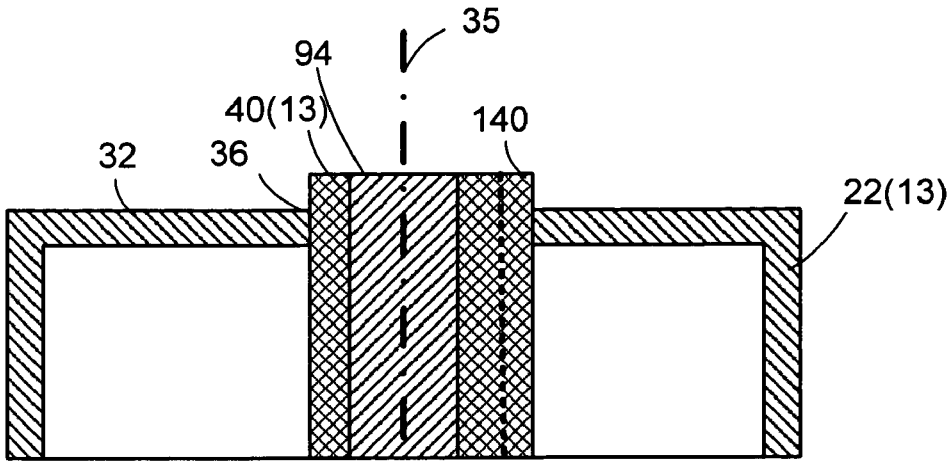
FIG. 13A is a side sectioned view of portions of another example embodiment magnetic latching solenoid.
Figure 13B:
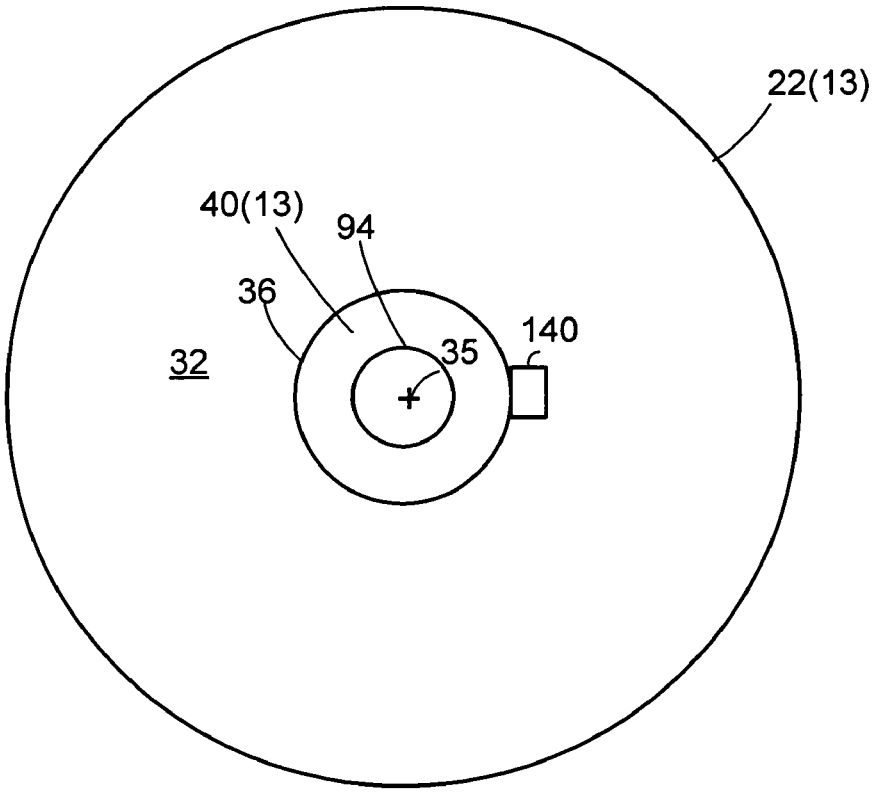
FIG. 13B is a top view of the example embodiment of FIG. 13A.

Plunger rotation with an actuation can be a source of release time variations and/or hold force variation for a magnetic latching solenoid. FIG. 13A and FIG. 13B show portions of a magnetic latching solenoid, and particularly portions of housing 22(13) and plunger 40(13) which have features for counteracting plunger rotation. The features of the various example embodiments described herein are combinable with features of other example embodiments, and accordingly the features of the FIG. 13A embodiment can be combined with the other embodiments described herein and encompassed hereby. In the example embodiment of FIG. 13, a keyed element prevents the moveable member (e.g., the moveable magnetically permeable member) from rotating about axis 35. In the particular illustration of FIG. 13, plunger 40(13) carries a radially extending key 140. The key 140 extends radially beyond the circumference of the remainder of plunger 40(13), and fits into a correspondingly formed groove in plunger aperture 36 on housing end wall 32. The key 140 can extend axially substantially the length of the plunger 40, and slides axially in the accommodating groove. The keyed arrangement prevents plunger 40(13), and thus the entire moveable magnetically permeable member, from rotating and thereby becoming a further source of hold force or release force variation. Other keyed or rotation prevention structures are also encompassed, including having an indention or groove formed in the plunger and a corresponding key extending radially into the indentation or groove from the plunger aperture.

In the example implementations, the stationary magnetic assembly is distinct from the housing, and the housing is preferably non-magnetically permeable (e.g., plastic, or even brass or aluminum). Thus, in the example embodiments described herein the magnetic latching solenoids have a separate housing to enclose their magnetic components. The housing does not carry magnetic flux nor is it a part of the active magnetic circuit. With typical magnetic latching solenoids, the housing is metal (magnetically conductive) and necessary for proper magnetic operation. In the technology of the embodiments herein described, the housing is only a containment vessel. In some example embodiments, the housing comprises plastic (which allows for mounting features, quieter operation, etc. but when end of travel impact forces get very large, a nonmagnetic metal case (aluminum, brass, etc.) can be implemented.

Magnetic latching solenoids need to be flexible in order to meet the customer's application requirements. Factors such as power levels, mounting schemes and the mechanical interfaces to the application need to be considered with every design. The technology described herein allows for flexibility in all those regards. The housing 22 is preferably plastic and cylindrical in nature to contain the components. A variety of mounting features can easily be molded into the plastic housing.

Although one bobbin and coil assembly is shown in the illustrated embodiments (e.g., bobbin 72 with coil 76), the bobbin, coil (wire size, number of turns, etc.) and metal components can easily be modified to accommodate various release power levels for different spring force requirements.

Adaptors of different materials and geometries can also be pressed onto the spring guide housing to properly interface with customer applications.

By way of review, release power variations and/or hold force variations are most undesirable in a magnetic latching solenoid. The hold force variations are variations in the holding or attracting force of the permanent magnet for the moveable member. Sources of release time variations and/or hold force variation include: 1) plunger rotation with each actuation, 2) mating surfaces which are not flat or parallel, 3) spring forces which cause uneven lift of the moveable member away from the stationary member and 4) bearing surfaces for the moveable member that don't adequately guide the moveable member back to its "original" location.

Aspects of the present technology described above have addressed, either alone or in combination, each of these sources. For example, a keyed element (e.g., plunger keyed to an opening in the housing) prevents the moveable member from rotating. Moreover, when the adjustable central core section (e.g., pole member) is pressed into place against the central core of the moveable member, the two members "mate" to better align with their contacting surface. Further, the large outer diameter of a conical spring results in a more uniform lift force as the moveable member releases from the stationary members. Yet further, the large outer diameter and length of the moveable member provide a good bearing surface to guide the moveable member back to its original latch position. Still further, the larger mass of the moveable member in a mid air gap design reduces the impact of the spring pushing the moveable member in a non-preferred direction.

Advantages of the technology include but are not limited to the following:

- Maximization of efficiency of the magnetic circuit by placing the air gap interface (e.g., interface 70) in the middle of the metallic and magnetically permeable members of the magnetic latching solenoid.
- Reduction in the impact of flatness variations in metal components due to adjustable pole piece.
- Virtually elimination of air gaps at all critical interface surfaces due to the assembly process.
- Reduction of release power variation due to the design geometry of mating components and bearing surfaces.
- A scalable design for different power levels.
- Optional mounting configurations and output shaft adaptors.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A solenoid comprising:

a housing comprising a housing first end, the housing at least partially defining a housing cavity, the housing cavity having an essentially open housing mouth;

a moveable magnetically permeable member which translates at least partially within the housing from a latched position to a stroked position along an axis, the moveable magnetically permeable member comprising a moveable mating surface at least partially lying in a plane transverse to the axis when in the latched position;

a stationary magnetic assembly situated at least partially in the housing and in the cavity inserted through the housing mouth, the stationary magnetic assembly comprising:

a stationary case member which at least partially defines a case cavity and comprises a first magnetized mating surface;

a pole member comprising a second magnetized mating surface;

a permanent magnet, the permanent magnet generating a permanent magnetic flux field in the pole member, in the moveable magnetically permeable member, and in the stationary case member sufficient to retain the moveable magnetically permeable member essentially in contact with the stationary magnetically permeable assembly at an air gap interface between the stationary magnetically permeable assembly and the moveable magnetically permeable member when in the latched position;

the pole member being selective positioned through the housing mouth and within the case cavity along the axis and whereby the second magnetized mating surface is positionable along the axis in a direction toward the moveable mating surface in a manner that is dependent only on the location of the movable magnetic mating surface;

a plate for conducting the permanent magnetic flux field and completing a magnetic circuit comprising the stationary magnetically permeable member, the permanent magnet, the plate, and the moveable magnetically permeable member;

a counter flux generator;

a spring which biases the moveable magnetically permeable member away from the stationary magnetically permeable assembly when a counter flux generated by the counter flux generator overcomes the permanent magnetic flux.

2. The apparatus of claim 1, wherein the stationary magnetic assembly is distinct from the housing, and wherein the housing is non-magnetically permeable.

3. The apparatus of claim 1, wherein the pole member is located between the moveable magnetically permeable member and the permanent magnet with respect to the axis.

4. The apparatus of claim 1, wherein the air gap interface extends in a radial direction which is orthogonal to the axis.

5. The apparatus of claim 4, wherein at the air gap interface a magnetic flux path is essentially parallel to the axis.

6. A solenoid comprising:

a housing which at least partially defines a housing cavity;

a moveable magnetically permeable member which translates at least partially within the housing from a latched position to a stroked position along an axis, the moveable magnetically permeable member comprising a moveable magnetically permeable member portion confined within the housing cavity, the moveable magnetically permeable member comprising two moveable mating surfaces, the two moveable mating surfaces both lying in a first radial plane but being spaced apart in the first radial plane;

a stationary magnetic assembly situated at least partially in the housing and in the housing cavity, the stationary magnetic assembly comprising two stationary mating surfaces lying in a second radial plane but being spaced apart in the second radial plane;

wherein an air gap interface is provided between the two moveable mating surfaces and the two stationary mating surfaces and essentially mid-way between opposite axial extremities of (1) the moveable magnetically permeable member portion confined within the housing cavity and (2) the stationary magnetic assembly;

whereby at the air gap interface a magnetic flux path is essentially parallel to the axis.

7. The apparatus of claim 6, wherein the moveable magnetically permeable member further comprises:

a plunger; and a housing-confined shoulder surface contiguous to the plunger and lying at least partially in a first plane transverse to the axis when in the latched position.

8. The apparatus of claim 6, wherein the stationary magnetic assembly further comprises:

a stationary magnetically permeable member comprising a first of the two stationary mating surfaces;

a permanent magnet, the permanent magnet positioned to generate a permanent magnetic flux field in the stationary magnetically permeable member and in the moveable magnetically permeable member sufficient to retain the moveable magnetically permeable member essentially in contact with the stationary magnetically permeable member at the air gap interface when in the latched position;

a plate for conducting the permanent magnetic flux field and completing a magnetic circuit comprising the stationary magnetically permeable member, the permanent magnet, the plate, and the moveable magnetically permeable member.

9. The apparatus of claim 8, further comprising:

a counter flux generator positioned at least partially in the moveable member cavity and at least partially in the stationary cavity, the counter flux generator operable to move the moveable magnetically permeable member away from the stationary magnetically permeable assembly to the stroked position;

a spring which biases the moveable magnetically permeable member away from the stationary magnetically permeable assembly when a counter flux generated by the counter flux generator overcomes the permanent magnetic flux.

10. The apparatus of claim 6, wherein two air gap interfaces are provided essentially mid-way between the opposite axial extremities of (1) the moveable magnetically permeable member portion confined within the housing cavity and (2) the stationary magnetic assembly, the two air gap interfaces extending in a radial direction which is orthogonal to the axis, the two air gap interfaces being spaced apart from one another in the radial direction.

11. The apparatus of claim 10, further comprising a counter flux generator, and wherein the two air gap interfaces are separated by the counter flux generator in the radial direction.

12. The apparatus of claim 6, wherein the air gap interface extends in a radial direction which is orthogonal to the axis.

13. The apparatus of claim 12, wherein at the air gap interface a magnetic flux path is essentially parallel to the axis.

14. A solenoid comprising:

a housing configured to at least partially define a housing cavity;

a moveable magnetically permeable member which translates at least partially within the housing from a latched position to a stroked position along an axis, the moveable magnetically permeable member comprising two moveable mating surfaces, the two moveable mating surfaces both lying in a first radial plane but being spaced apart in the first radial plane by an axially extending moveable member cavity;

a stationary magnetic assembly situated at least partially in the housing and in the housing cavity, the stationary magnetic assembly comprising a permanent magnet and two stationary mating surfaces, the two stationary mating surfaces lying in a second radial plane but being spaced apart in the second radial plane by an axially extending stationary cavity, the stationary cavity being axially aligned with the moveable member cavity;

the permanent magnet being positioned to generate a permanent magnetic flux field in the stationary magnetic assembly and in the moveable magnetically permeable member sufficient to retain the moveable magnetically permeable member essentially in contact with the stationary magnetic assembly at an air gap interface between the stationary magnetic assembly and the moveable magnetically permeable member when in the latched position whereby the two moveable mating surfaces essentially respectively contact the two stationary mating surfaces at the air gap;

a counter flux generator positioned at least partially in the moveable member cavity and at least partially in the stationary cavity, the counter flux generator operable to move the moveable magnetically permeable member away from the stationary magnetically permeable assembly to the stroked position;

a spring which biases the moveable magnetically permeable member away from the stationary magnetically permeable assembly when a counter flux generated by the counter flux generator overcomes the permanent magnetic flux;

wherein an axial extent of the moveable magnetically permeable member along the axis is essentially the same as an axial extent of the stationary magnetic assembly along the axis.

15. The apparatus of claim 14, wherein the stationary magnetically permeable member comprises:

a stationary case member which at least partially defines a case cavity and comprises a first stationary mating surface;

a pole member which is selectively positioned within the case cavity along the axis to provide a second stationary mating surface independently positionable relative to the first stationary mating surface along the axis.

16. The apparatus of claim 15, wherein the moveable magnetically permeable member comprises an axially extending central portion and an axially extending peripheral portion, and wherein the moveable magnetically permeable member comprises the two moveable mating surfaces, a first moveable mating surface being provided on the axially extending central portion and a second moveable mating surface being provided on the axially extending peripheral portion.

17. The apparatus of claim 16, wherein the moveable member cavity is defined between the axially extending central portion and an axially extending peripheral portion of the moveable magnetically permeable member, and wherein the stationary cavity is defined between the stationary case member and the pole member.

18. The apparatus of claim 17, wherein the spring comprises a conical spring situated in the moveable member cavity, wherein the conical spring has a first end coil lying in a first spring end plane and a second end coil lying in a second spring end plane, and wherein the second end coil has a greater diameter than the first end coil.

19. The apparatus of claim 18, wherein one end coil of the conical spring contacts a radially extending interior surface of the moveable magnetically permeable member, wherein the flux generator comprises a bobbin frame, and wherein another of the end coils of the conical spring contacts the bobbin frame.

20. The apparatus of claim 18, wherein the second end coil contacts a radially extending interior surface of the moveable magnetically permeable member, wherein the flux generator comprises a bobbin frame, wherein the bobbin frame comprises an axially extending bobbin flange and a transverse bobbin flange, and wherein the first end coil is separated from the moveable magnetically permeable member by the axially extending bobbin flange.

21. The apparatus of claim 14, wherein the air gap interface extends in a radial direction which is orthogonal to the axis.

22. The apparatus of claim 21, wherein at the air gap interface a magnetic flux path is essentially parallel to the axis.

23. The apparatus of claim 14, wherein the counter flux generator is at least partially exposed within the cavity when the moveable member is in the stroked position.

24. The apparatus of claim 14, wherein the stationary magnetic assembly comprises:

a stationary magnetically permeable member comprising the two stationary mating surfaces;

the permanent magnet;

a plate for conducting the permanent magnetic flux field and completing a magnetic circuit comprising the stationary magnetically permeable member, the permanent magnet, the plate, and the moveable magnetically permeable member.

25. The apparatus of claim 24, further comprising:

a cover which encloses the housing cavity, the moveable magnetically permeable member, the stationary magnetically permeable member, the permanent magnet, and the plate being axially aligned in this order within a volume defined by the housing and the cover.

26. The apparatus of claim 24, wherein the stationary magnetically permeable member is located between the moveable magnetically permeable member and the permanent magnet with respect to the axis.

27. The apparatus of claim 14, wherein the housing is non-magnetically permeable.

28. The apparatus of claim 14, wherein the two moveable mating surfaces are magnetized mating surfaces and wherein the two stationary mating surfaces are magnetized mating surfaces.

* * * * *